US007949457B2

(12) United States Patent
Ishikawa et al.

(10) Patent No.: US 7,949,457 B2
(45) Date of Patent: May 24, 2011

(54) CONTROL APPARATUS FOR INTERNAL COMBUSTION ENGINE

(75) Inventors: Shinichi Ishikawa, Tochigi-ken (JP); Kazuhito Tokugawa, Tochigi-ken (JP)

(73) Assignee: Keihin Corporation (JP)

( * ) Notice: Subject to any disclaimer, the term of this patent is extended or adjusted under 35 U.S.C. 154(b) by 270 days.

(21) Appl. No.: 12/200,757

(22) Filed: Aug. 28, 2008

(65) Prior Publication Data

US 2009/0063008 A1 Mar. 5, 2009

(30) Foreign Application Priority Data

Aug. 29, 2007 (JP) ..... 2007-223064
Aug. 29, 2007 (JP) ..... 2007-223193

(51) Int. Cl.
*F02D 45/00* (2006.01)
*F02D 1/08* (2006.01)

(52) U.S. Cl. ..... 701/102; 123/631

(58) Field of Classification Search ..... 123/631, 123/406.58, 406.6; 701/102; 290/1 A
See application file for complete search history.

(56) References Cited

U.S. PATENT DOCUMENTS 5,020,506 A * 6/1991 Ozawa ..... 123/631
5,778,862 A * 7/1998 Fukui ..... 123/631
6,474,273 B1 * 11/2002 Kinoshita et al. ..... 123/41 E
6,668,799 B2 * 12/2003 Ohira ..... 123/406.58
7,461,621 B2 * 12/2008 Ota et al. ..... 123/179.4
2002/0112536 A1 * 8/2002 Shimoyama et al. ..... 73/117.3
2009/0076704 A1 * 3/2009 Tokugawa et al. ..... 701/102

FOREIGN PATENT DOCUMENTS

JP 2780257 5/1998
JP 3125587 11/2000
JP 3375679 11/2002
JP 2005-220866 8/2005

* cited by examiner

*Primary Examiner* — Stephen K Cronin
*Assistant Examiner* — Arnold Castro
(74) *Attorney, Agent, or Firm* — Cantor Colburn LLP

(57) ABSTRACT

A control apparatus for an internal combustion engine, includes: a crankshaft; a crank angle detection unit; a generator; and a control unit to which alternating voltage signals are input, that ascertains ignition timings based on crank signals, performs ignition control so as to spark the internal combustion engine at the ignition timings, performs polarity determination processing in which the control unit determines a polarity of the alternating voltage signal each predetermined cycle and determines a current polarity determination result, and performs reverse rotation detection processing in which the control unit obtains the current polarity determination result each time the crank signal is detected so that the control unit ascertains a polarity cycle of the alternating voltage signals and in which the control unit determines that the crankshaft is in reverse rotation and stops the ignition control.

3 Claims, 21 Drawing Sheets

AT FORWARD ROTATION

AT REVERSE ROTATION

CONTROL APPARATUS FOR INTERNAL COMBUSTION ENGINE

BACKGROUND OF THE INVENTION

This application is based on and claims priority from Japanese Patent Application No. 2007-223193, filed on Aug. 29, 2007, and Japanese Patent Application No. 2007-223064, filed on Aug. 29, 2007, the contents of which are incorporated herein by reference, 1. Field of the Invention The present invention relates to a control apparatus for an internal combustion engine, and particularly, to a control apparatus for an internal combustion engine having a reverse rotation detecting function of the internal combustion engine.

2. Description of Related Art

When ignition is made before a compression top dead center in a case where the rotational speed of a crankshaft is insufficient at the startup (cranking) of an internal combustion engine by manual operation, a phenomenon, so-called rebounding of kick pedal in which the crankshaft makes reverse rotation and a reverse rotation load is applied to manual starting operation devices (e.g., kick arm) may occur.

As techniques for preventing such rebounding of kick pedal, techniques mentioned in the following (1) and (2) are conventionally known.

(1) As disclosed in Japanese Patent No. 2780257, in an ignition device that performs ignition output according to an output voltage signal of a crank angle position detecting timing sensor (crank sensor), when the ignition device detects that an output voltage signal of a predetermined phase of the crank sensor does not coincide with an output voltage of one of the predetermined phases of a magnet-type AC generator that rotates in synchronization with a crankshaft, ignition output is stopped.

(2) As disclosed in Japanese Patent No. 3125587, in an ignition device that has a power source coil exclusive for ignition (so-called exciter coil) that is packaged in a magnet-type AC generator, the power source coil outputs an alternating voltage with a plurality of cycles per one revolution in synchronization with the rotation of a crankshaft, the ignition device causes ignition output to be stopped according to an output voltage of an exciter coil with a predetermined phase.

In the above conventional techniques, when any noises are generated in output voltage signals of the magnet-type AC generator that is used for detection of reverse rotation (including the exciter coil), the reverse rotation may be erroneously detected only by detecting the predetermined phases of these signals once. Furthermore, startup of an internal combustion engine may be disabled, or there is concern that an engine stall is caused if the engine is under operation.

Furthermore, when an abnormality, such as a case where the magnet-type AC generator or the exciter coil is short-circuited from other power sources (e.g., a multi-phase generator or a battery), the reverse rotation cannot be detected, and rebounding of kick pedal cannot be prevented.

Meanwhile, as the techniques for detecting the reverse rotation of an internal combustion engine, techniques mentioned in the following (3) to (5) are known.

(3) As disclosed in Japanese Patent No. 2780257, when an ignition device detects that a signal of a predetermined phase of a rank sensor does not match to an output voltage of one of the predetermined phases of an AC generator, the ignition device determines reversal rotation, and ignition output is stopped.

(4) As disclosed in Japanese Unexamined Patent Application, First Publication No. S62-75075, a counter-electromotive force that is generated by a normally meshing-type starter motor is detected at the time of reverse rotation, and a spark is prevented.

(5) As disclosed in Japanese Patent No. 3375679, two projections including a reference projection and an auxiliary projection is provided in a timing rotor that rotates in synchronization with a crankshaft, and reverse rotation is detected based on the detection timing of these projections.

Furthermore, generally, in order to release a reverse rotation detection result (that is, ignition prohibition), an engine stall (crank rotation stop) is necessary.

As disclosed in Japanese Unexamined Patent Application, First Publication No. 2005-220866, a technique for releasing ignition prohibition is known. Specifically, in the case where, after reverse rotation is detected by the technique similar to the above-described (3), when negative pulses of the AC generator have been detected greater than or equal to 4 times (equivalent to ½ rotation), or when a predetermined time has elapsed from the reverse rotation detection, ignition prohibition is released.

In a case where an engine stall is adopted as a release condition of the above-described reverse rotation detection result, when a starter motor or a manual startup device (e.g., kick pedal) is operated continuously, startup may be disabled without releasing the reverse rotation detection result.

Furthermore, when the pulse number of the AC generator, crank signal input, and elapsed time are adopted as release conditions of the reverse rotation detection result, since engine forward rotation is not detected, there is concern that the reverse rotation detection result (ignition output permission) is released at the time of reverse rotation. In that case, parts (e.g., starter idle gears, and an engine body) constituting a startup drive system may be damaged.

SUMMARY OF THE INVENTION

The invention has been conceived in view of the above-described circumstances, and it is an object of thereof to provide a control apparatus for an internal combustion engine in which it is possible to improve the reverse rotation detection accuracy of an internal combustion engine, and prevent rebounding of kick pedal more reliably.

Furthermore, it is another object of the invention to provide a control apparatus for an internal combustion engine in which it is possible to prevent disabled startup, and any damage of parts constituting a startup drive system or an internal combustion engine body, after reverse rotation of the internal combustion engine was detected.

In order to achieve the above described object, the control apparatus for an internal combustion engine of a first aspect of the invention, includes: a crankshaft provided in the internal combustion engine; a crank angle detection unit that is provided in the internal combustion engine and that outputs a crank signal each time the crankshaft rotates by a predetermined angle; a generator that rotates in synchronization with the rotation of the crankshaft and that outputs alternating voltage signals with one-phase; and a control unit, to which the alternating voltage signals are input, that ascertains ignition timings based on the crank signals, performs ignition control so as to spark the internal combustion engine at he ignition timings, performs polarity determination processing in which the control unit determines a polarity of the alternating voltage signal each predetermined cycle and determines a current polarity determination result when the polarities are identical over predetermined times, and performs reverse rotation detection processing in which the control unit obtains the current polarity determination result each tone the crank signal is detected so that the control unit ascertains a polarity cycle of the alternating voltage signals and in which the control unit determines that the crankshaft is in reverse rotation and stops the ignition control when the ignition timing has arrived and the polarity cycle does not coincide with a polarity cycle at the time the crankshaft is in forward rotation.

Moreover, it is preferable that, in the control apparatus of the first aspect of the invention, the predetermined cycle be less than or equal to ¼ of an inter-crank signal time between a previous crank signal detection and a current crank signal detection.

Moreover, it is preferable that the control apparatus of the first aspect of the invention farther include: a reference voltage source generating reference voltage signals; a comparing unit, to which the alternating voltage signals and the reference voltage signals are input, that compares the voltage value of the alternating voltage signals with the voltage value of the reference voltage signals, and that outputs comparison result signals indicating a comparison result; and a waveform shaping unit, to which the crank signals are input, that performs waveform shaping so that the crank signals are formed into square-wave pulse signals, the cycle of the pulse signal being the time required for the rotation of the predetermined angle. In the control apparatus, the control unit determines the polarity of the alternating voltage signals based on the comparison result signals in the polarity determination processing, and obtains the current polarity determination each time the pulse signal is detected so as to ascertain the polarity cycle of the alternating voltage signals in the reverse rotation detection processing.

According to the first aspect of the invention, when the polarity of an alternating voltage signal is output from the generator (e.g., magnet-type AC generator) each predetermined cycle, and when the polarities are identical over predetermined times, this polarity is determined as a current polarity determination result. As a result, even if any noise is generated in alternating voltage signals, the polarity of the alternating voltage signals can be accurately determined.

Also, since the reverse rotation is detected on the basis of the polarity cycle of the alternating voltage signals obtained from such an accurate polarity determination result, the erroneous detection of the reverse rotation can be prevented, the reverse rotation detection accuracy of an internal combustion engine can be improved, and the rebounding of kick pedal can be more reliably prevented.

Furthermore, when abnormalities, such as short-circuiting, are caused in the generator, the polarity cycle of an alternating voltage signal differs from a cycle at the time of forward rotation. Therefore, similarly to the reverse rotation detection, when the polarity cycle does not coincide with a polarity cycle at the time of forward rotation of the crank, the rebounding of kick pedal can be prevented even at the time of occurrence of an abnormality by determining to be the crank reverse rotation to stop the ignition control.

In order to achieve the above described object, the control apparatus for an internal combustion engine of a second aspect of the invention, includes: a crankshaft provided in the internal combustion engine; a crank angle detection unit that is provided in the internal combustion engine and that outputs a crank signal each time the crankshaft rotates by a predetermined angle; a reverse rotation detection unit detecting whether or not the crankshaft is in reverse rotation; and a control unit that ascertains ignition timings based on the crank signals, performs ignition control so as to spark the internal combustion engine at the ignition timings, prohibits the ignition of the internal combustion engine due to a reverse rotation detection result based on the detection in the reverse rotation detection unit, and releases the reverse rotation detection result when the crankshaft is returned to a forward rotation state after the control unit has determined that the crankshaft is in reverse rotation.

Moreover, it is preferable that, in the control apparatus of the second aspect of the invention, when the control unit detects a crank angle reference position based on the crank signals so that the control unit ascertains a rotational position of the crankshaft, the control unit determine that the crankshaft has been returned to a forward rotation state.

Moreover, it is preferable that the control apparatus of the second aspect of the invention further include: a waveform shaping unit, to which the crank signals are input, that performs waveform shaping so that the crank signals are formed into square-wave pulse signals, the cycle of the pulse signal being the time required for the rotation of the predetermined angle. In the control apparatus, the pulse signals includes a high-level period and a low-level period that is adjacent to the high-level period, and the control unit calculates a time ratio based on the time of the high-level period and the time of the low-level period and determines that the crank angle reference position is detected when a value obtained by subtracting the previous time ratio from the current time ratio is greater than or equal to a first threshold value and when a value obtained by subtracting the current time ratio from the previous time ratio is greater than or equal to a second threshold value.

Moreover, it is preferable that, in the control apparatus of the second aspect of the invention, when the control unit determines a stroke in the internal combustion engine, the control unit determine that the crankshaft was returned to a forward rotation state.

Moreover, it is preferable that the control apparatus of the second aspect of the invention further include: an intake state detection unit that detects an intake state value that indicates an intake state in the internal combustion engine and outputs intake state signals. In the control apparatus, the control unit, to which the intake state signals are input, calculates an intake state value based on the intake state signal each time a predetermined crank angle arrives based on the crank signal, and determines that the stroke in the internal combustion engine is a intake stroke when a value obtained by subtracting the current intake state value from the previous intake state value is greater than or equal to a third threshold value.

Moreover, it is preferable that, in the control apparatus of the second aspect of the invention, an intake pressure signal corresponding to the intake pressure inside an intake pipe of the internal combustion engine or an intake rate signal corresponding to the intake rate inside the intake pipe be used as the intake state signal.

In the second aspect of the invention, in a control apparatus for an internal combustion engine, that the control apparatus performs ignition control for igniting the internal combustion engine with ignition timing and has a function to detect the reverse rotation of a crankshaft, and prohibits the ignition of the internal combustion engine due to a reverse rotation detection result. The reverse rotation detection result is released if the crankshaft returns to a forward rotation state after the detection of reverse rotation.

That is, even if a starter motor or a manual startup device (kick pedal, etc.) is continuously operated by releasing the reverse rotation detection result after returning to forward rotation, startup can be prevented from being disabled.

Furthermore, since the reverse rotation detection result is not released at the time of reverse rotation, any damage of startup drive system parts (e.g., starter idle gears) or an engine body can be prevented.

DETAILED DESCRIPTION OF THE INVENTION

An embodiment of the invention will be described with reference made to the drawings.

Figure 1:
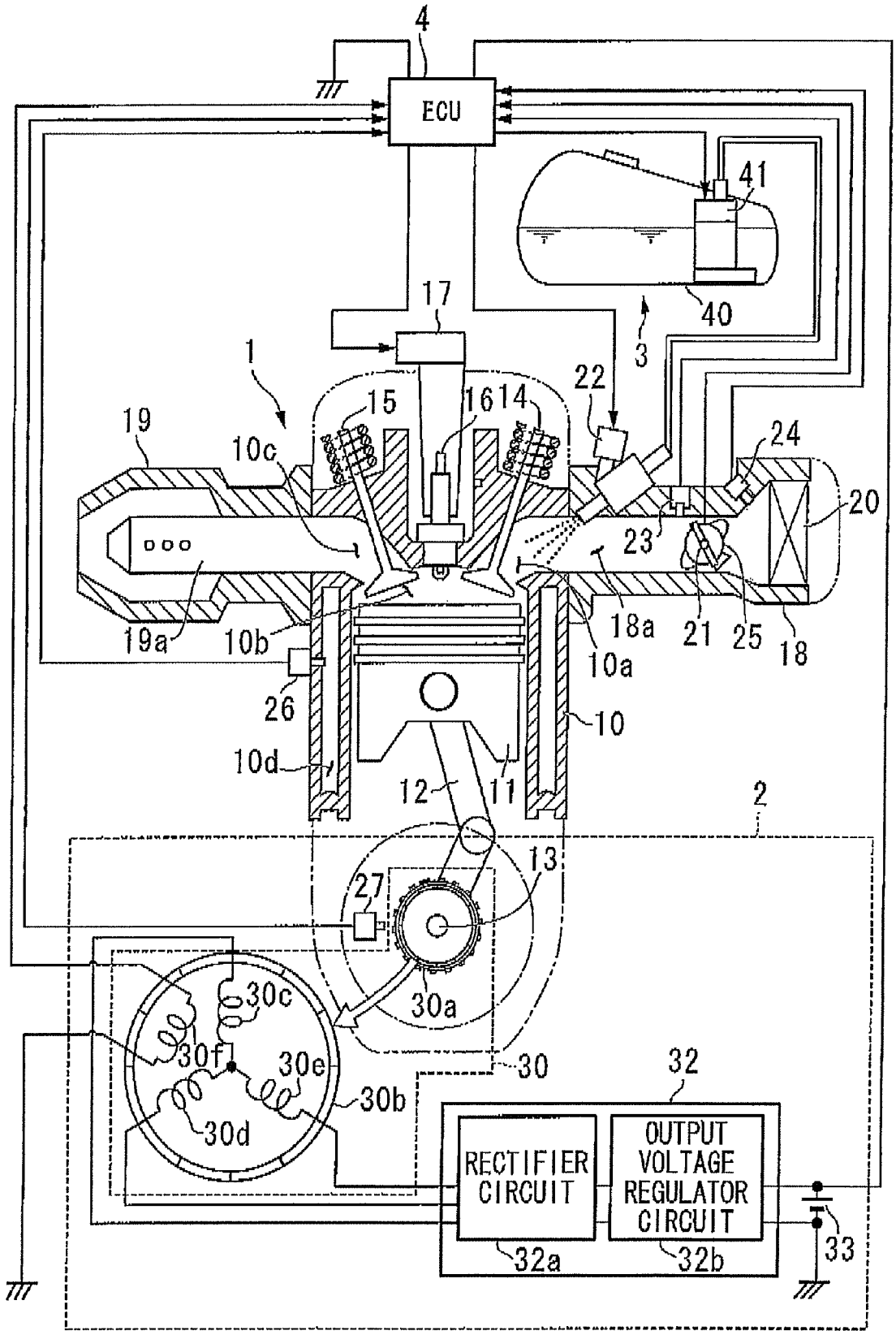
FIG. 1 is a structural schematic diagram of an engine system that is provided with a control apparatus for an internal combustion engine (ECU 4) according to a first embodiment of the invention.

FIG. 1 is a structural schematic view showing an engine control system that is provided with the fuel injection control apparatus (referred to below as an ECU) of the embodiment.

As shown in FIG. 1, the engine control system of the embodiment is schematically formed by an engine 1, a power supply unit 2, a fuel supply unit 3, and an ECU (Engine Control Unit) 4.

The engine (i.e., internal combustion engine) 1 is a four-stroke single-cylinder engine, and schematically includes a cylinder 10, a piston 11, a conrod 12, a crankshaft 13, an intake valve 14, an exhaust valve 15, a spark plug 16, an ignition coil 17, an intake pipe 18, an exhaust pipe 19, an air cleaner 20, a throttle valve 21, an injector 22, an intake pressure sensor 23, an intake temperature sensor 24, a throttle opening angle sensor 25, a cooling water temperature sensor 26, and a crank angle sensor 27.

The cylinder 10 is a hollow circular cylinder-shaped component that is used to make the piston 11 that is located inside it undergo a reciprocating motion by repeating a four-stroke cycle consisting of intake, compression, combustion (i.e., expansion), and exhaust.

The cylinder 10 has an intake port 10*a*, a combustion chamber 10*b*, and an exhaust port 10*c*.

The intake port 10*a* is a flow path that is used to supply a mixture formed from air and fuel to the combustion chamber 10*b*.

The combustion chamber 10*b* is a space that is used to store the aforementioned mixture and cause mixture that has been compressed in the compression stroke to be combusted in the combustion stroke.

The exhaust port 10*c* is a flow path that is used to discharge exhaust gas from the combustion chamber 10*b* to the outside in the exhaust stroke.

Moreover, a water cooling path 10*d* that is used to circulate cooling water is provided in an outer wall of the cylinder 10.

The crankshaft 13 that is used to convert the reciprocating motion of the piston 11 into rotational motion is joined via the conrod 12 to the piston 11.

The crankshaft 13 extends in a direction that is orthogonal to the reciprocation direction of the piston 11. A flywheel (not shown), a mission gear, a kick gear that is joined to a kick pedal that is used to start the engine 1 manually, and a rotor 30*a* of the power supply unit 2 (described below) are joined to the crankshaft 13.

The intake valve 14 is a valve component that is used to open and close an aperture portion of the air intake port 10*a* which is near to the combustion chamber 10*b*, and is joined to a camshaft (not shown). The intake valve 14 is driven to open and close in accordance with the respective strokes by this camshaft.

The exhaust valve 15 is a valve component that is used to open and close an aperture portion of the air exhaust port 10*c* which is near to the combustion chamber 10*b*, and is joined to a camshaft (not shown). The exhaust valve 15 is driven to open and close in accordance with the respective strokes by this camshaft.

The spark plug 16 has electrodes that face towards the interior of the combustion chamber 10*a*, and is provided in a topmost portion of the combustion chamber 10*b*. The spark plug 16 generates a spark between the electrodes by a high-voltage ignition voltage signal that is supplied from the ignition coil 17.

The ignition coil 17 is a transformer that is formed by a primary coil and a secondary coil. The ignition coil 17 boosts an ignition voltage signal that is supplied from the ECU 4 to the primary coil and supplies an ignition voltage signal from the secondary coil to the spark plug 16.

The intake pipe 18 is an air supply pipe, and has an intake flow path 18*a* provided inside it.

The intake pipe 18 is joined to the cylinder 10 so that the intake flow path 18*a* is connected to the intake port 10*a*.

The exhaust pipe 19 is a pipe for discharging exhaust gas, and has an exhaust flow path 19*a* provided inside it.

The exhaust pipe 19 is joined to the cylinder 10 so that the exhaust flow path 19*a* is connected to the exhaust port 10*c*.

The air cleaner 20 is located upstream from the air flowing through the interior of the intake pipe 18.

The air cleaner 20 purifies air taken in from the outside and supplies it to the intake flow path 18*a*.

The throttle valve 21 is provided inside the intake flow path 18*a*, and pivots by a throttle (not shown) or an accelerator.

Namely; the cross-sectional area of the intake flow path 18*a* is changed by the pivoting of the throttle valve 21, and the air intake quantity is accordingly changed.

The injector 22 has an injection aperture that injects fuel that is supplied from the fuel supply unit 3 in accordance with injector drive signals that are supplied from the ECU 4.

The injector 22 is provided inside the intake pipe 18 so that the injection aperture faces the intake port 10*a*.

The intake pressure sensor (i.e., intake state detection unit) 23 is, for example, a semiconductor pressure sensor that utilizes a piezoresistive effect.

The intake pressure sensor 23 is provided in the intake pipe 18 at a position downstream from the airflow passing through the throttle valve 21 so that a sensitive surface of the intake pressure sensor 23 is oriented towards the intake flow path 18*a*.

The intake pressure sensor 23 outputs intake pressure signals (intake state signals) that correspond to the intake pressure (an intake state value) inside the intake pipe 18 to the ECU 4.

The intake temperature sensor 24 is provided in the intake pipe 18 at a position upstream from the airflow passing through the throttle valve 21 so that a sensitive portion of the intake temperature sensor 24 is oriented towards the intake flow path 18*a*.

The intake temperature sensor 24 outputs intake temperature signals that correspond to the intake air temperature inside the intake pipe 18 to the ECU 4.

The throttle opening angle sensor 25 outputs throttle opening angle signals that correspond to the opening angle of the throttle valve 21 to the ECU 4.

The cooling water temperature sensor 26 is provided so that a sensitive portion of the cooling water temperature sensor 26 is oriented towards the cooling water path 10*d* of the cylinder 10.

The cooling water temperature sensor 26 outputs cooling water temperature signals that correspond to the temperature of the cooling water flowing through the cooling water path 10*d* to the ECU 4.

The crank angle sensor (i.e., a crank angle detection unit) 27 outputs a crank signal each time the crankshaft 13 rotates by a predetermined angle in synchronization with the rotation of the crankshaft 13. The crank angle sensor 27 is described in detail below.

The power supply unit 2 includes a generator 30, a regulate rectifier 32, and a battery 33.

The generator 30 is a magnetic AC generator and includes a rotor 30*a*, permanent magnets 30*b*, 3-phase stator coils 30*c*, 30*d*, and 30*e*, and a reverse rotation detecting coil (reverse rotation detection unit) 30*f*.

The rotor 30*a* is joined to the crankshaft 13 of the engine 1 and rotates in synchronization therewith.

The permanent magnets 30*b* are mounted on an inner circumferential side of the rotor 30*a*.

The 3-phase stator coils 30*c*, 30*d*, and 30*e* are coils that are used to obtain generated output.

Namely, in the generator 30, as a result of the rotor 30*a* (in other words, the permanent magnets 30*b*) rotating relative to the fixed stator coils 30*c*, 30*d*, 30*e*, and the reverse rotation detecting coil 30*f*, 3-phase AC voltage signal is generated by electromagnetic induction from the stator coils 30*c*, 30*d*, and 30*e*, and one-phase AC voltage signal is generated from the reverse rotation detecting coil 30*f*. The 3-phase AC voltage signal that has been generated from the stator coils 30*c*, 30*d*, and 30*e* is output to the regulate rectifier 32. The alternating voltage signal that has been generated from the reverse rotation detecting coil 30*f* is output to the ECU 4.

Figure 2:
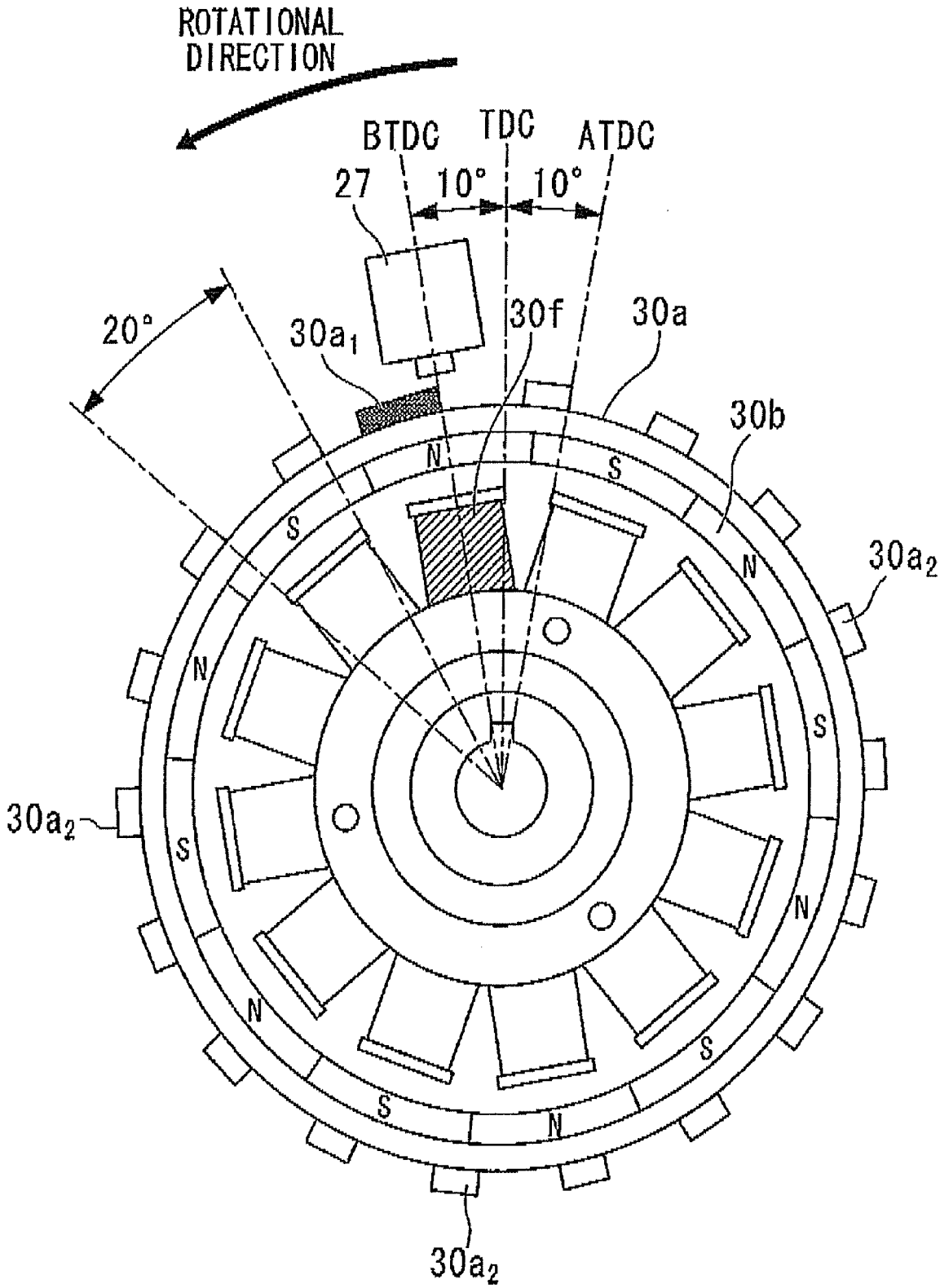
FIG. 2 is a detailed explanatory diagram showing a rotor 30*a* constituting a generator 30 according to the first embodiment of the invention.

As shown in FIG. 2, a plurality of projections is formed on an outer circumference of the rotor 30*a* extending in the rotation direction of the rotor 30*a*.

Specifically, a plurality of projections (i.e., auxiliary projections) $\mathbf{30}a_2$ whose length is shorter in the rotation direction, and a projection (i.e., a crank angle reference projection) $\mathbf{30}a_1$ whose length in the rotation direction is longer than that of the projections $\mathbf{30}a_2$, are formed on the outer circumference of the rotor 30*a*.

Here, the length of the crank angle reference projection $\mathbf{30}a_1$ is, as an example, approximately twice the length of the auxiliary projections $\mathbf{30}a_2$.

The plurality of auxiliary projections $\mathbf{30}a_2$ and the crank angle reference projection $\mathbf{30}a_1$ are provided so that the respective rear ends of each of the plurality of auxiliary projections $\mathbf{30}a_2$ and the crank angle reference projection $\mathbf{30}a_1$ are located at the same angular interval (for example, at 20° intervals).

In the embodiment, the crank angle reference position is a position to the front in the rotation direction of a position corresponding to the top dead center TDC, for example, the position BTDC 10° which is a position 10° before the top dead center.

In addition, the position of the rear end of the crank angle reference projection $\mathbf{30}a_1$ matches the crank angle reference position.

In addition, the position of rear end of the auxiliary projections $\mathbf{30}a_2$, that is the position to the back in the rotation direction of the crank angle reference projection $\mathbf{30}a_1$, namely, the position 10° back a position corresponding to the top dead center TDC in the rotation direction, referred to ATDC.

Moreover, the permanent magnets 30*b* are mounted on the inner circumferential side of the rotor 30*a*.

Specifically, the permanent magnets 30*b* that are constructed with an N pole and an S pole forming one set are placed every 60° along the inner circumferential side of the rotor 30*a*.

The reverse rotation detecting coil 30*f* is provided at the crank angle reference position. One end (first end) of the reverse rotation detecting coil 30*f* is connected to a ground line. The other end (second end) of the reverse rotation detecting coil 30*f* is connected to the ECU 4, specifically, connected to an inversion input terminal of a comparator circuit 53. Namely, the reverse rotation detecting coil 30*f* generates one-phase AC voltage signal whose cycle is the length of time it takes for the rotor 30*a* (crankshaft 13) to rotate 60°.

The aforementioned crank angle sensor 27 is, for example, an electromagnetic pickup sensor and, as shown in FIG. 2, is provided in the vicinity of the outer circumference of the rotor 30*a*.

The crank angle sensor 27 outputs a pair of pulse signals having mutually different polarities each time the crank angle reference projection $\mathbf{30}a_1$ and the auxiliary projections $\mathbf{30}a_2$ pass the vicinity of the crank angle sensor 27.

More specifically, the crank angle sensor 27 outputs a pulse signal having a negative polarity amplitude when the front end of each projection goes past in the rotation direction, and outputs a pulse signal having a positive polarity amplitude when the rear end of each projection goes past in the rotation direction.

The description returns now to FIG. 1.

The regulate rectifier 32 includes a rectifier circuit 32*a* and an output voltage regulator circuit 32*b*.

The rectifier circuit 32*a* includes six rectifier circuits that are connected in a 3-phase bridge structure and are used to rectify the 3-phase AC voltage input from the respective stator coils 30*c*, 30*d*, and 30*e*. The rectifier circuit 32*a* rectifies this 3-phase AC voltage to DC voltage and outputs it to the output voltage regulator circuit 32*b*.

The output voltage regulator circuit 32*b* rectifies the DC voltage input from the rectifier circuit 32*a*, and generates power supply voltage, and supplies the power supply voltage to the ECU 4 and the battery 33.

The battery 33 is charged depending on the power supply voltage supplied from the output voltage regulator circuit 32*b*. The battery 33 supplies power supply voltage to the ECU 4 when the generator 30 does not supplies power supply voltage to the ECU 4, for example, startup.

The fuel supply unit 3 is formed by a fuel tank 40 and a fuel pump 41.

The fuel tank 40 is a container that is used to hold fuel such as, for example, gasoline.

The fuel pump 41 is provided inside the fuel tank 40, and pumps out fuel inside the fuel tank 40 and supplies it to the injector 22 in accordance with pump drive signals input from the ECU 4.

Figure 3:
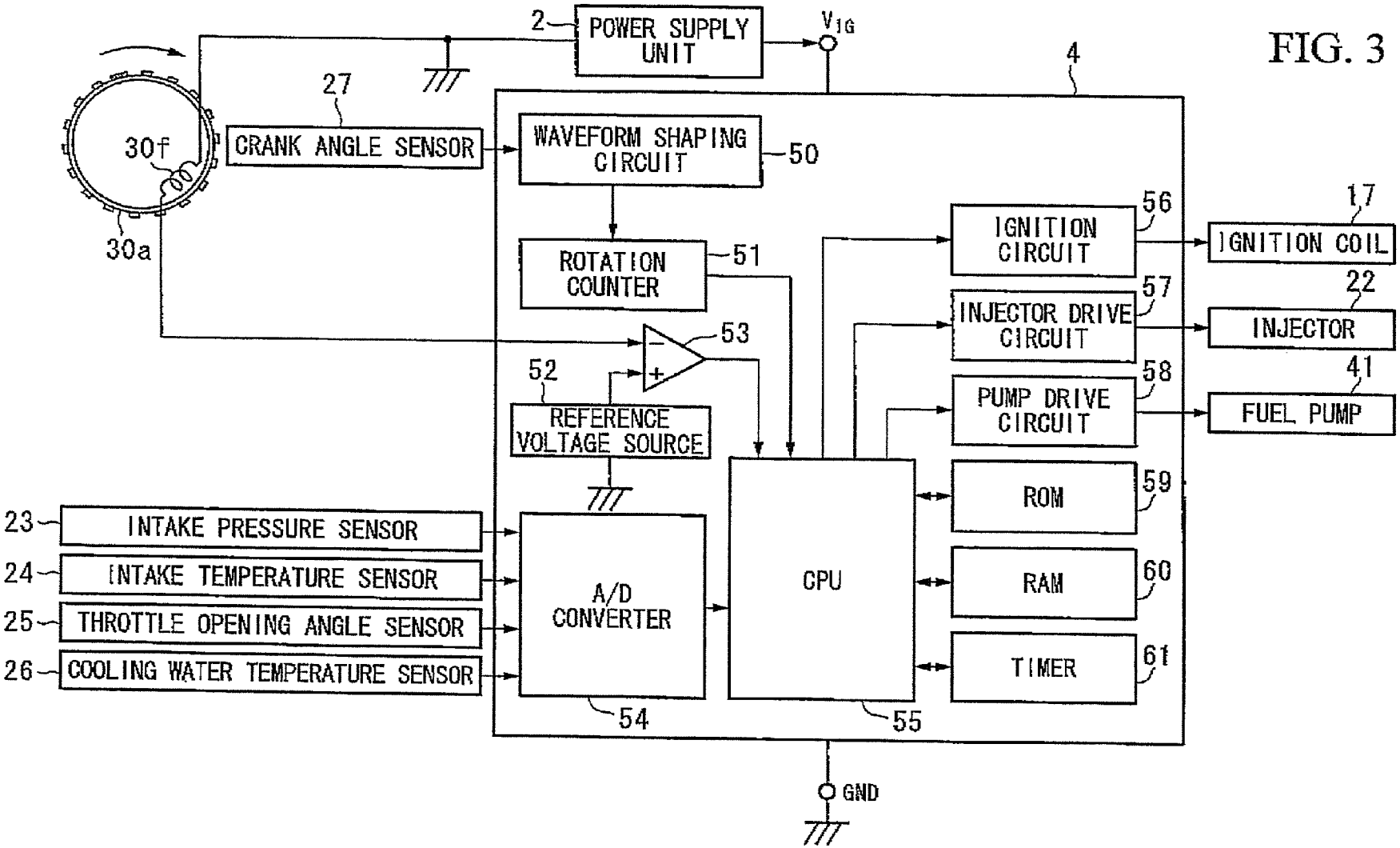
FIG. 3 is a structural block diagram of the control apparatus for an internal combustion engine (ECU 4) according to the first embodiment of the invention.

As shown in FIG. 3, the ECU 4 includes a waveform shaping circuit 50, a rotation number counter 51, a reference voltage source 52, a comparator circuit 53, an A/D converter 54, a CPU (Central Processing Unit) 55, an ignition circuit 56, an injector drive circuit 57, a pump drive circuit 58, ROM (Read Only Memory) 59, RAM (Random Access Memory) 60, and a timer 61.

The ECU 4 which is constructed in this manner is driven by power supply voltage that is supplied from the power supply unit 2.

A $V_{IG}$ terminal of the ECU 4 is connected to an output terminal on a positive pole side of the output voltage regulator circuit 32*b*.

A GND terminal of the ECU 4 is connected to a ground line and to a terminal on a negative pole side of the battery 33.

The waveform shaping circuit (waveform shaping unit) 50 performs waveform shaping to change pulse form crank signals that are input from the crank angle sensor 27 into square wave pulse signals (for example, to change negative polarity crank signals into high level signals, and change positive polarity crank and ground level crank signals into low level signals), and outputs the waveform-shaped signals to the rotation number counter 51 and the CPU 55.

Namely, these square wave pulse signals are square wave pulse signals whose cycle is the length of time it takes for the crankshaft 13 to rotate 20°.

The rotation number counter 51 calculates the engine speed based on the square wave pulse signals that are output from the above-described waveform shaping circuit 50, and outputs a rotation count signal that shows the relevant engine speed to the CPU 55.

The reference voltage source 52 generates reference voltage signal that is DC voltage having a negative-polarity, and outputs this reference voltage signal to a non-inversion input terminal of the comparator circuit 53. The comparator circuit (comparing unit) 53 is constituted by an operational amplifier including an inversion input terminal and a non-inversion input terminal. The alternating voltage signal that is output from the reverse rotation detecting coil 30*f* is input to the inversion input terminal of the comparator circuit 53. The reference voltage signal that is output from reference voltage source 52 is input to the non-inversion input terminal of the comparator circuit 53. The comparator circuit 53 compares the voltage value of the above-described alternating voltage signal with the voltage value of the reference voltage signal, and outputs a comparison result signal indicating a comparison result to the CPU 55. Specifically, when the voltage value of the alternating voltage signal is greater than the voltage value of the reference voltage signal, the comparator circuit 53 outputs the comparison result signal having a high level. When the voltage value of the alternating voltage signal is less than the voltage value of the reference voltage signal, the comparator circuit 53 outputs the comparison result signal having a low level.

The A/D converter 54 converts into digital signals intake pressure sensor outputs that are output from the intake pressure sensor 23, intake temperature sensor outputs that are output from the intake temperature sensor 24, throttle opening angle sensor outputs that are output from the throttle opening angle sensor 25, and cooling water temperature sensor outputs that are output from the cooling water temperature sensor 26, and then outputs these digital signals to the CPU 55.

The CPU (i.e., control unit) 55 executes an engine control program that is stored in the ROM 59, and performs control of the fuel injection, ignition, and fuel supply of the engine 1 based on the crank signals, the rotation count signals that are output from the rotation number counter 51, the comparison result signals that are output from the comparator circuit 53, the intake pressure values that have been converted by the A/D converter 54, the throttle opening angle values, and cooling water temperature values.

Specifically, the CPU 55 outputs ignition control signals to the ignition circuit 56 in order to cause the spark plug 16 to spark at the ignition timing. The CPU 55 also outputs fuel injection control signals to the injector drive circuit 57 in order to cause a predetermined quantity of fuel to be injected from the injector 22 at the fuel injection timing, and also outputs fuel supply control signals to the pump drive circuit 58 in order for fuel to be supplied to the injector 22.

The ignition circuit 56 is provided with a condenser (not shown) that accumulates $V_{IG}$ voltage, namely, the power supply voltage which is supplied from the power supply unit 2, and, in accordance with an ignition control signal input from the above-described CPU 55, discharges the electric charge which has accumulated in the condenser as an ignition voltage signal to a primary coil of the ignition coil 17.

In accordance with fuel injection control signals that are input from the above described CPU 55, the injector drive circuit 57 generates injector drive signals in order to cause a predetermined quantity of fuel to be injected from the injector 22, and outputs these injector drive signals to the injector 22.

In accordance with fuel supply control signals that are input from the CPU 55, the pump drive circuit 58 generates pump drive signals in order to cause fuel to be supplied from the fuel pump 41 to the injector 22, and outputs these pump drive signals to the fuel pump 41.

The ROM 59 is non-volatile memory in which engine control programs that are executed by the CPU 55 and various types of data are stored in advance.

The timer 60 is working memory that is used to temporarily hold data when the CPU 55 is executing an engine control program and performing various operations.

The timer 61 performs predetermined timer (i.e., clock) operations under the control of the CPU 55.

Next, the reverse rotation prevention processing of an ECU 4 (in particular, a CPU 55) during the operation of an engine 1 in an engine control system that is provided with the ECU 4 (a control apparatus for an internal combustion engine) of a first embodiment that is constructed in the manner described above will be described.

In addition, as the reverse rotation prevention processing, the CPU 55 executes coil voltage polarity determination processing for determining the polarity of alternating voltage signals output from the reverse rotation detecting coil 30*f*, and reverse rotation detection processing for detecting the reverse rotation of the engine 1 on the basis of a polarity determination result by this coil voltage polarity determination processing in parallel. Hereinafter, the coil voltage polarity determination processing will first be described.

Coil Voltage Polarity Determination Processing

Figure 4:
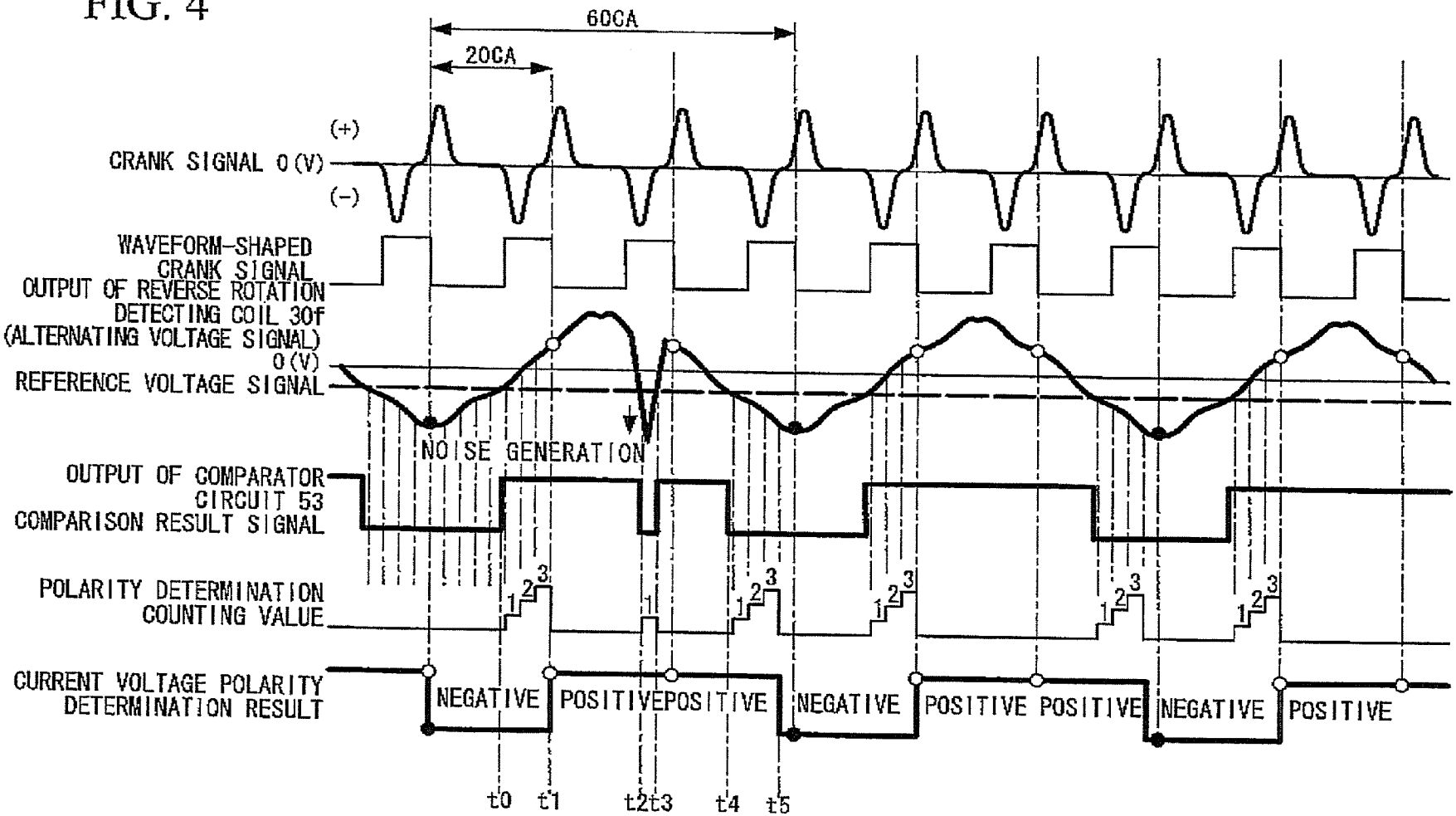
FIG. 4 is an explanatory diagram relating to the operation of the control apparatus for an internal combustion engine (ECU 4) according to the first embodiment of the invention.

FIG. 4 is a timing chart showing the correspondence relationship among crank signals output from the crank angle sensor 27, waveform-shaped crank signals output from the waveform shaping circuit 50, alternating voltage signals output from the reverse rotation detecting coil 30*f*, reference voltage signals output from the reference voltage source 52, comparison result signals output from the comparator circuit 53, and polarity determination result (current voltage polarity determination results) of alternating voltage signals.

As shown in FIG. 4, during the operation of the engine 1, the rotor 30*a* also rotates in synchronization with the rotation of the crankshaft 13, and the crank angle sensor 27 outputs pulsed crank signals having a negative-polarity amplitude when the front end of each projection passes therethrough in the rotational direction, and outputs pulsed crank signals having a positive-polarity amplitude when the rear end of each projection passes therethrough in the rotational direction.

Furthermore, the waveform shaping circuit 50 outputs crank signals (square-wave pulse signals) the waveform of which has been shaped such that negative-polarity crank signals have a high level, and positive polarity and ground-level crank signals have a low level.

That is, the time between falling edges of waveform-shaped crank signals is equivalent to the time which is taken for the crankshaft 13 to rotate 20°.

Furthermore, from the reverse rotation detecting coil 30*f*, alternating voltage signals in which the time which is taken for the rotor 30*a* (crankshaft 13) to rotate 60° becomes one cycle are output. From the comparator circuit 53, high-level comparison result signals are output when the voltage values of alternating voltage signals are greater than the voltage values of reference voltage signals (i.e., when the alternating voltage signals have a positive polarity), and low-level comparison result signals are output when the voltage values of the alternating voltage signals are less than the voltage values of reference voltage signals (i.e., when the alternating voltage signals have a negative polarity).

During the operation of the engine 1, the CPU 55 performs the coil voltage polarity determination processing on the basis of the above comparison result signals.

Figure 5:
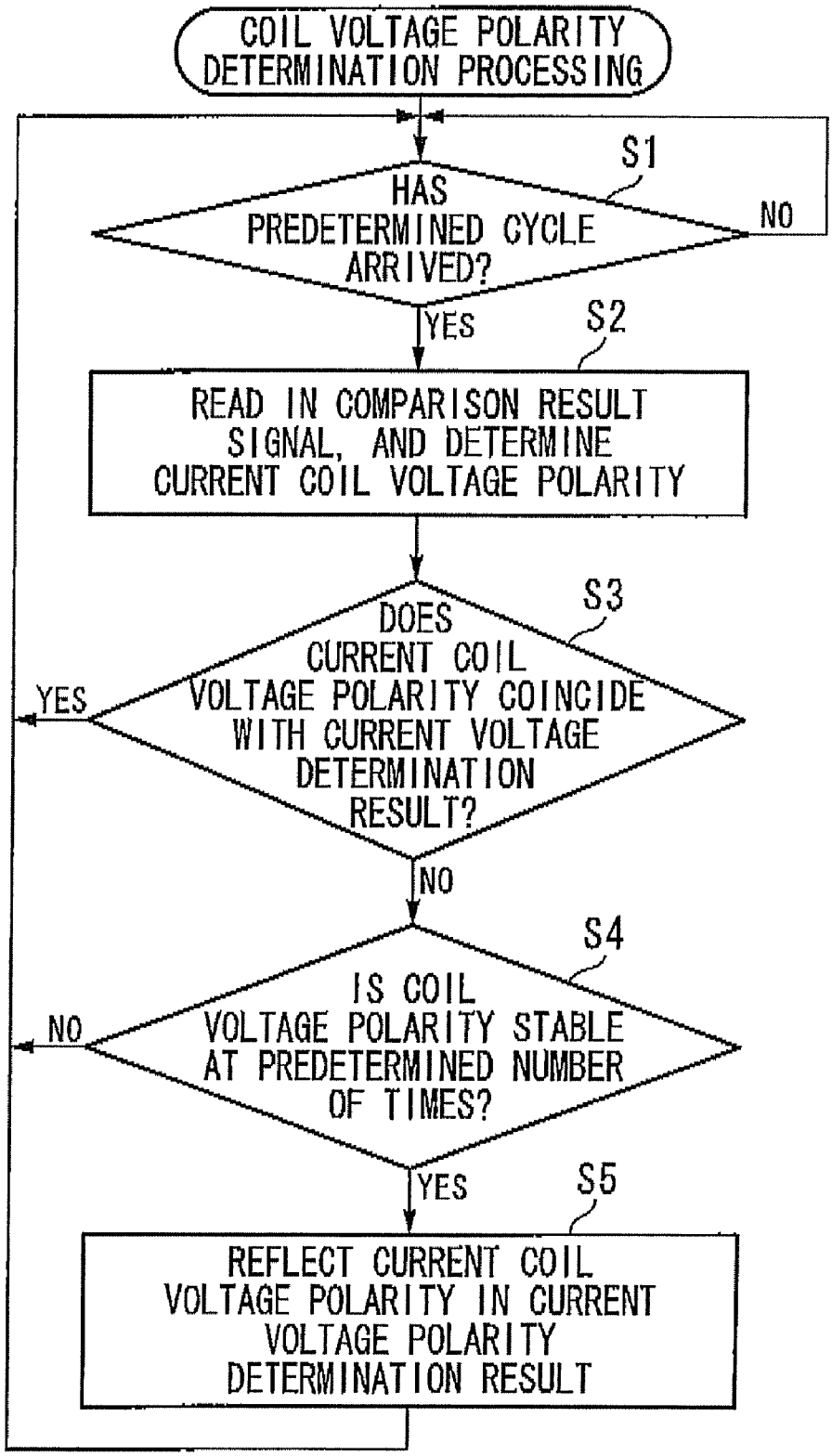
FIG. 5 is a flowchart relating to the operation of the control apparatus for an internal combustion engine (ECU 4) according to the first embodiment of the invention.

FIG. 5 is an operation flowchart of the CPU 55 relating to the coil voltage polarity determination processing.

As shown in FIG. 5, first, the CPU 55 controls the timer 61 to determine whether or not a comparator output detection cycle predetermined cycle) has arrived (Step S1).

This comparator output detection cycle is desirably set to be less than or equal to ¼ of an inter-crank signal time between a previous crank signal detection and a current crank signal detection. In other word, the inter-crank signal time is the time between crank signals (time between falling edges of waveform-shaped crank signals). In the first embodiment, as shown in FIG. 4, the detection cycle is set to 512 (μsec).

By using a short cycle as the comparator output detection cycle, as described below, even if any pulsed noises are generated in alternating voltage signals output from the reverse rotation detecting coil 30*f*, the polarity of the alternating voltage signals can be accurately determined.

If the comparator output detection cycle has not arrived in the above Step S1 ("NO"), the CPU 55 repeats the processing of Step S1 and, if the comparator output detection cycle has arrived ("YES"), the CPU fetches a comparison result signal, and determines the polarity (hereinafter referred to as "current coil voltage polarity") of a current alternating voltage signal (Step S2).

That is, if the comparison result signal has a high level, the CPU 55 determines the current coil voltage polarity to be a positive polarity, and if the comparison result signal has a low level, the CPU determines the current coil voltage polarity to be a negative polarity.

Then, the CPU 55 determines whether or not the current coil voltage polarity coincides with a polarity determination result (current voltage polarity determination result) of the current alternating voltage signal stored in the RAM 60 (Step S3).

In this Step S3, if the current coil voltage polarity and the current voltage polarity determination result coincide with each other ("YES"), the CPU 55 returns to the processing of Step S1.

On the other hand, if, in Step S3, the current coil voltage polarity and the current voltage polarity determination result do not coincide with each other ("NO"), the CPU 55 determines whether or not the current coil voltage polarity is stable at the identical polarity over predetermined times (for example, three times) (Step S4).

In this Step S4, if the current coil voltage polarity is not stable at the identical polarity over predetermined times ("NO"), the CPU 55 returns to the processing of Step S1.

On the other hand, if, in Step S4, the current coil voltage polarity is stable at the identical polarity over predetermined times ("YES"), the CPU 55 reflects the current coil voltage polarity in the current voltage polarity determination result (stores the current coil voltage polarity as a new current voltage polarity determination result to the RAM 60), and returns to the processing of Step S1 (Step S5).

Processing of Steps S3 to S5 will be concretely described with reference to FIG. 4.

As shown in FIG. 4, assuming a case where the current voltage polarity determination result is a low level (i.e.; negative polarity) before a point of time t0, and the comparison result signal has a high level at the point of time t0 (i.e., the current coil voltage polarity has become a positive polarity), the CPU 55 proceeds to the processing of Step S4 because the current coil voltage polarity and the current voltage polarity determination result do not coincide with each other in the processing of Step S3, and determines whether or not the current coil voltage polarity is stable at the identical polarity positive polarity in FIG. 4) over predetermined times (three times).

Here, as shown in FIG. 4, the CPU 55 counts the number of times by which the current coil voltage polarity has been a positive polarity in every comparator output detection cycle. If the current coil voltage polarity has been a positive polarity three times point of time t1), the CPU proceeds to the processing of Step S5, and reflects the current coil voltage polarity in the current voltage polarity determination result, and stores it as a new current voltage polarity determination result in the RAM 60.

That is, although the current voltage polarity determination result has been a low level (i.e., negative polarity) before the point of time t1, the current voltage polarity determination result becomes a high level (i.e., positive polarity) after the point of time t1.

Then, since the comparison result signal is still a high-level in a period of points of time t1 to t2, the current coil voltage polarity and the current voltage polarity determination result coincide with each other, and the current voltage polarity determination result is maintained at a high level (i.e., positive polarity).

Here, as shown in FIG. 4, it is assumed that a pulsed noise is generated in an alternating voltage signal, and the comparison result signal has transited to a low level (i.e., the current coil voltage polarity is a negative polarity) only for a period of points of time t2 to t3.

At this point of time t2, the current coil voltage polarity and the current voltage polarity determination result do not coincide with each other, the CPU 55 proceeds to the processing of Step S4, and counts the number of times by which the current coil voltage polarity has been a negative polarity in every comparator output detection cycle. However, since the comparison result signal transits to a high-level at a point of time t3, the number of times by which the current coil voltage polarity has been a negative polarity does not reach three times, but the current voltage polarity determination result is maintained at a high level (i.e., positive polarity).

Subsequently, assuming a case where the comparison result signal has transited to a low level (i.e., the current coil voltage polarity is a negative polarity) at point of time t4, the CPU 55 proceeds to the processing of Step S4 because the current coil voltage polarity and the current voltage polarity determination result do not coincide with each other in the processing of Step S3, and determines whether or not the current coil voltage polarity is stable at the identical polarity (negative polarity in FIG. 4 ) over predetermined times (three times).

Here, as shown in FIG. 4, the CPU 55 counts the number of times by which the current coil voltage polarity has been a negative polarity in every comparator output detection cycle. If the current coil voltage polarity has been a negative polarity three times (point of time t5), the CPU proceeds to the processing of Step 55, and reflects the current coil voltage polarity in the current voltage polarity determination result, and stores it as a new current voltage polarity determination result in the RAM 60.

That is, although the current voltage polarity determination result has been a high level (i.e., positive polarity) at the point of time t5, the current voltage polarity determination result becomes a low level (i.e., negative polarity) after the point of time t5.

As described above, if the polarity of an alternating voltage signal output from the reverse rotation detecting coil 30*f* is determined in a short cycle (less than or equal to ¼ of an inter-crank signal time) and is stable at the identical polarity over predetermined times, the polarity is determined as a current polarity. As a result, even if any pulsed noise is generated in an alternating voltage signal, the polarity of the alternating voltage signal can be accurately determined.

Reverse Rotation Detection Processing

Next, the reverse rotation detection processing performed in parallel with the aforementioned coil voltage polarity determination processing will be described.

Figure 6:
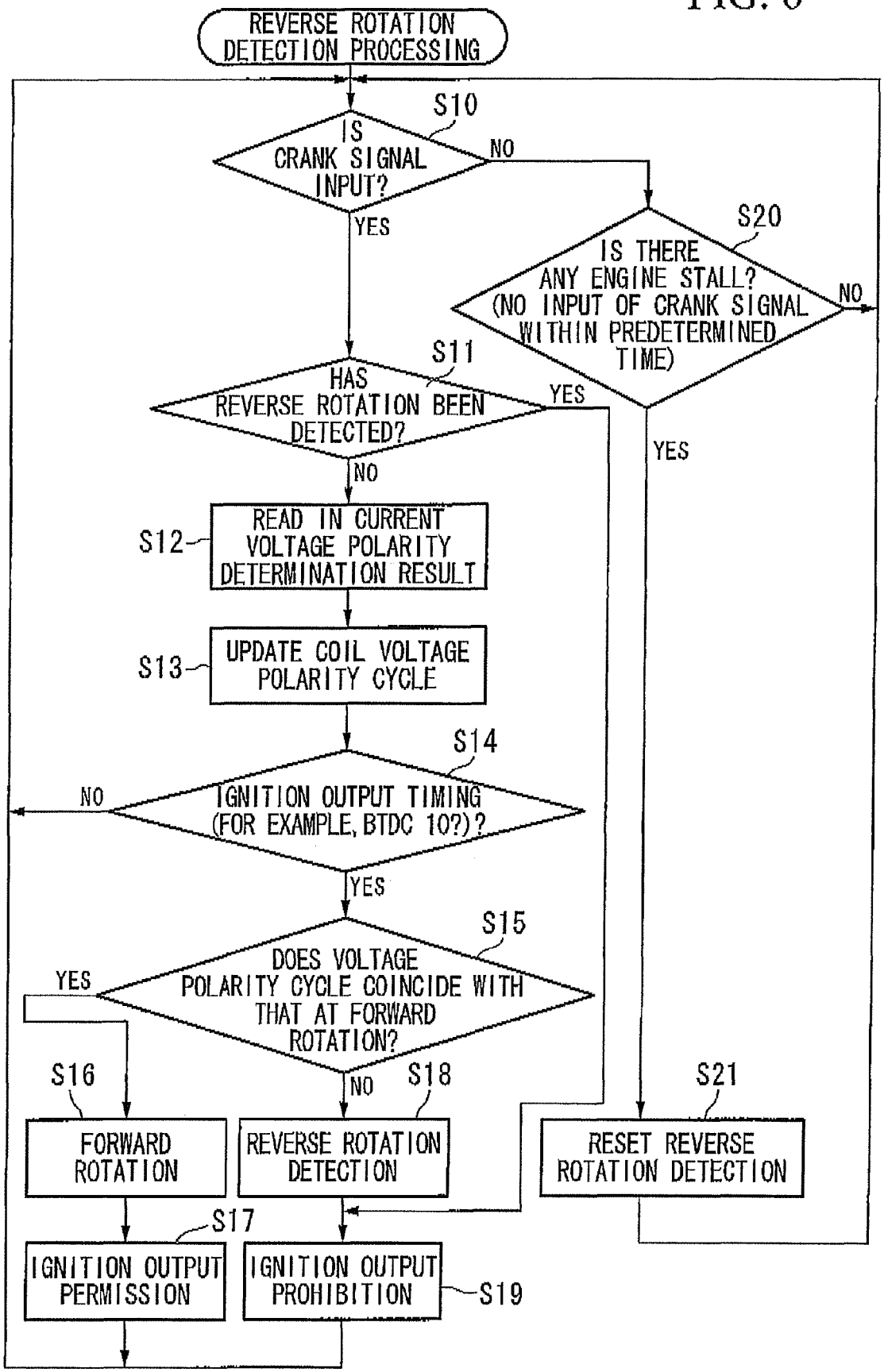
FIG. 6 is a flowchart relating to the operation of the control apparatus for an internal combustion engine (ECU 4) according to the first embodiment of the invention.

FIG. 6 is an operation flowchart of the CPU 55 relating to the reverse rotation detection processing.

As shown in FIG, 6, first, the CPU 55 determines whether or not a waveform-shaped crank signal has been input (a falling edge has been detected) (Step S10). If the waveform-shaped crank signal has been input ("YES"), the CPU determines whether or not reverse rotation detection has been finished (Step S11).

If, in this Step S11, the reverse rotation has been detected ("YES"), the CPU 55 proceeds to the processing of Step S19.

On the other hand, if, in Step S11, the reverse rotation detection is not finished ("NO"), the CPU 55 reads in a current voltage polarity determination result from the RAM 60 (Step S12), and updates the polarity cycle hereinafter referred to as "coil voltage polarity cycle") of an alternating voltage signal, on the basis of the current voltage polarity determination result (Step S13).

Then, the CPU 55 determines whether or not the ignition timing has arrived (i.e., whether or not the crank angle reference position has been detected) on the basis of the waveform-shaped cranks signal (Step S14).

Figure 7:
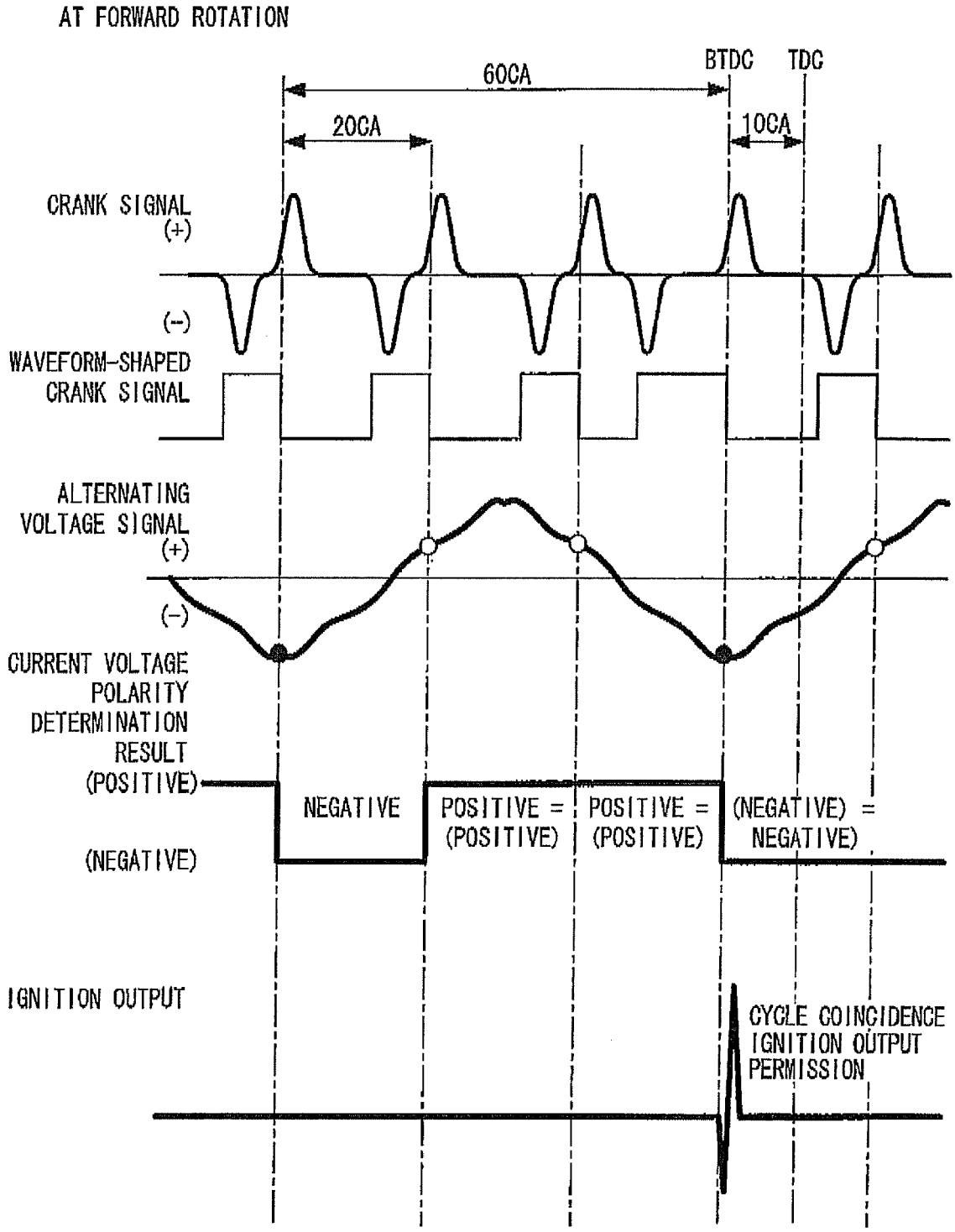
FIG. 7 is an explanatory diagram relating to the operation of the control apparatus for an internal combustion engine (ECU 4) according to the first embodiment of the invention.

As shown in FIG. 7, in the crank angle reference position, a crank angle reference projection $\mathbf{30}a_1$ having a large width passes through the crank angle sensor 27. Therefore, a pulse signal having a long high level period is generated. Therefore, if a falling edge of such a pulse signal having a long high-level period has been detected, it is possible to determine that the crank angle reference position has been detected (the ignition timing has arrived).

The CPU 55 performs the processing of detecting the crank angle reference position BTDC in parallel on the basis of the waveform-shaped crank signal, as described above, other than the coil voltage polarity determination processing and the reverse rotation detection processing.

If, in Step S14, the ignition timing has not arrived (i.e., if the crank angle reference position is not detected) ("NO"), the CPU 55 returns to the processing of Step S10.

On the other hand, if, in Step S14, the ignition timing has arrived (i.e., if the crank angle reference position has been detected) ("YES"), the CPU 55 determines whether or not the coil voltage polarity cycle coincides with a cycle at the time of forward rotation (Step S15).

Figure 8:
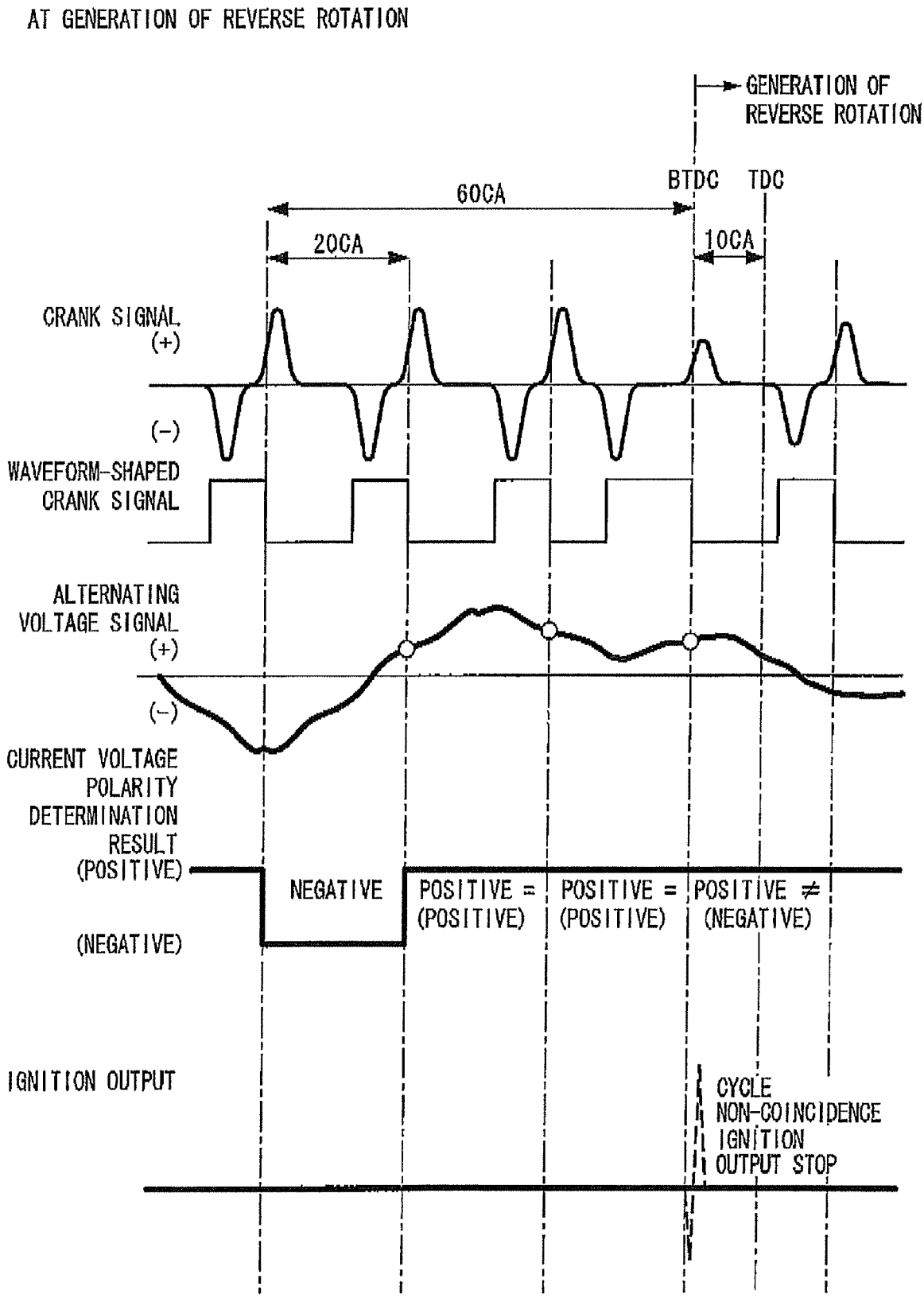
FIG. 8 is an explanatory diagram relating to the operation of the control apparatus for an internal combustion engine (ECU 4) according to the first embodiment of the invention.

FIG. 7 is a timing chart of individual signals at the time of forward rotation, and FIG. 8 is a timing chart of individual signals at the time of the generation of reverse rotation.

As shown in FIG. 7, at the time of forward rotation, whenever waveform-shaped crank signals are input three times, i.e., whenever the crankshaft 13 (rotor 30*a*) rotates 60°, a coil voltage polarity cycle including "positive polarity", "positive polarity", and "negative polarity" in order in one cycle is obtained.

On the other hand, as shown in FIG. 8, the coil voltage polarity cycle will change at the time of the generation of reverse rotation.

In an example of FIG. 8, although the cycle including "positive polarity", "positive polarity", and "negative polarity" in order is included in one cycle before the generation of reverse rotation, the place which is originally "negative polarity" becomes "positive polarity" after the generation of reverse rotation.

Figure 9:
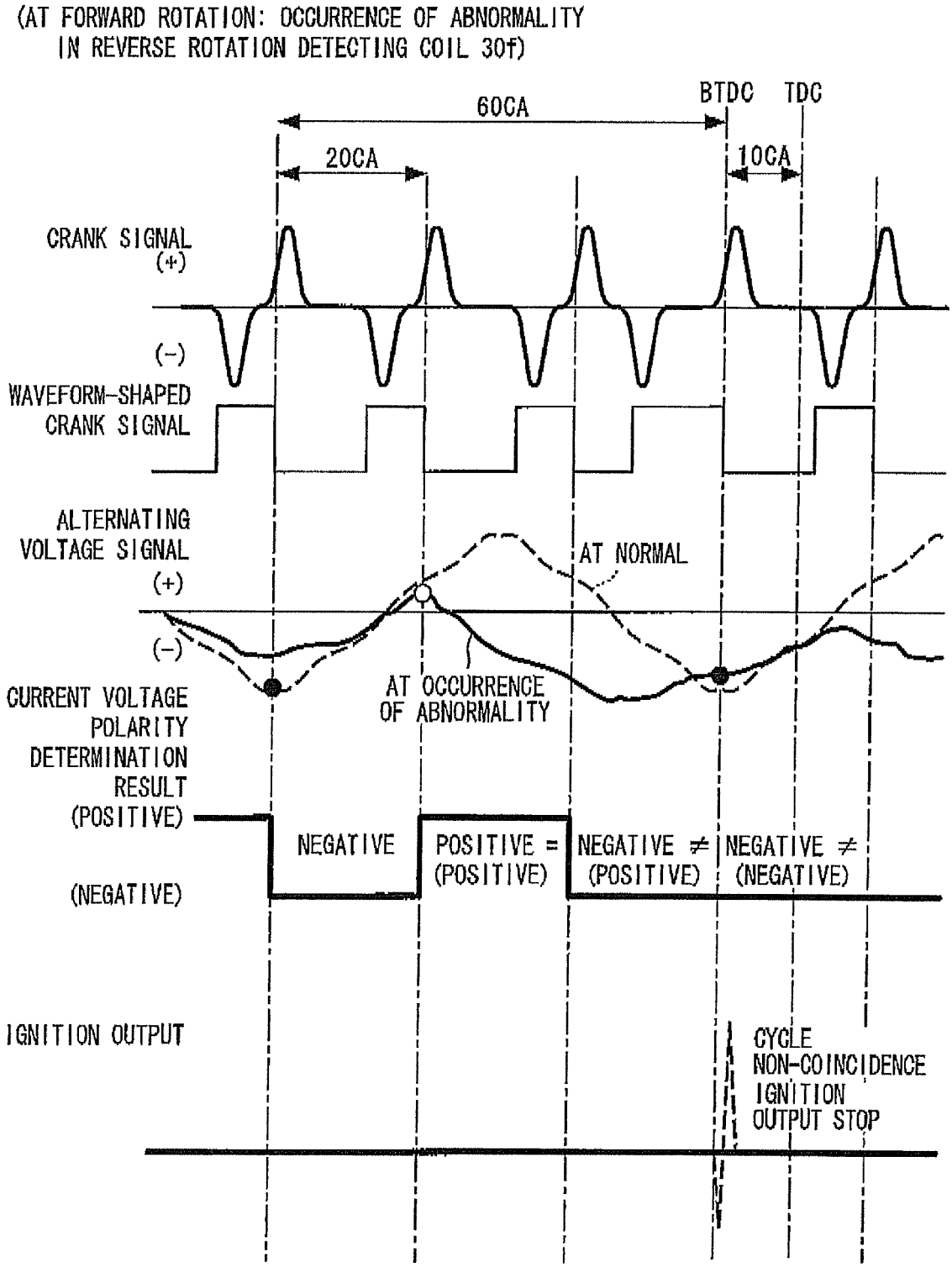
FIG. 9 is an explanatory diagram relating to the operation of the control apparatus for an internal combustion engine (ECU 4) according to the first embodiment of the invention.

Furthermore, although FIG. 9 is a timing chart of individual signals at the time of occurrence of an abnormality when the reverse rotation detecting coil 30*f* is short-circuited from the stator coils 30*c*, 30*d*, and 30*e*, the battery 33, etc. at the time of forward rotation, as shown in this figure, the coil voltage polarity cycle at the time of the occurrence of an abnormality will also differ from a cycle at the time of forward rotation.

That is, as shown in FIG. 7, if, in Step S15, the coil voltage polarity cycle coincides with a cycle at the time of forward rotation ("YES"), the CPU 55 determines that the engine 1 is in a forward rotation state (Step S16), and permits ignition output, i.e., outputs an ignition control signal for making an ignition plug 16 spark to the ignition circuit 56, and returns to the processing of Step S10 (Step S17).

On the other hand, as shown in FIGS. 8 and 9, if, in Step S15, the coil voltage polarity cycle does not coincide with a cycle at the time of forward rotation ("NO"), the CPU 55 determines what the engine 1 is in a reverse rotation state (Step S18), and prohibits ignition output, i.e., stops the output of an ignition control signal to the ignition circuit 56, and returns to the processing of Step S10 (Step S19).

Furthermore, if, in Step S10, any waveform-shaped crank signal is not input ("NO"), the CPU 55 controls the timer 61 to determine whether or not there is no input (engine stall) of a waveform-shaped crank signal within a predetermined time (Step S20).

If, in this Step S20, there is any input of a waveform-shaped crank signal within a predetermined time, i.e., if there is no engine stall ("NO"), the CPU 55 returns to the processing of Step S10, while if there is no input of a waveform-shaped crank signal within a predetermined time ("YES") (i.e., if it is determined to be an engine stall), the CPU resets a reverse rotation detecting state, and returns to the processing of Step S10 (Step S21).

As described above, according to the first embodiment, even if noise is generated in alternating voltage signals that are output signals of the reverse rotation detecting coil 30*f*, the polarity of the alternating voltage signals can be accurately determined. As a result, the erroneous detection of reverse rotation is prevented, the reverse rotation detection accuracy of the engine 1 can be improved, and the rebounding of kick pedal can be more reliably prevented.

Furthermore, even at the time of the occurrence of an abnormality like when the reverse rotation detecting coil 30*f* is short-circuited from the stator coils 30*c*, 30*d*, and 30*e*, the battery 33, etc., rebounding of kick pedal can be prevented by stopping the output of an ignition control signal to the ignition circuit 56 similarly to the detection of forward rotation.

In addition, in the above first embodiment, the reverse rotation detecting coil 30*f* exclusive for detection of reverse rotation is provided in the generator 30. However, the invention is not limited thereto. A magnet AC generator that rotates in synchronization with the crankshaft 13 and outputs one-phase alternating voltage signals may be provided in addition to the generator 30, and an exciter coil may be used as the reverse rotation detecting coil 30*f*.

Next, a second embodiment of the invention will be described.

In the second embodiment, release processing (hereinafter referred to as "reverse rotation release processing") of a reverse rotation detection result of the ECU 4 (in particular, of the CPU 55) during the operation of the engine 1 in the engine control system that is provided with the ECU 4 (i.e., the control apparatus for an internal combustion engine) that is constructed in the manner described above will be described.

Specifically, in the reverse rotation release processing in the second embodiment, a case where the crank angle reference position has been detected after the detection of reverse rotation is determined to be returned to a forward rotation state, and the reverse rotation detection result (ignition output prohibition) is released.

In addition, in the following second embodiment, the same components as those of the above first embodiment are denoted by the same reference numerals, and the description thereof is omitted.

Figure 10:
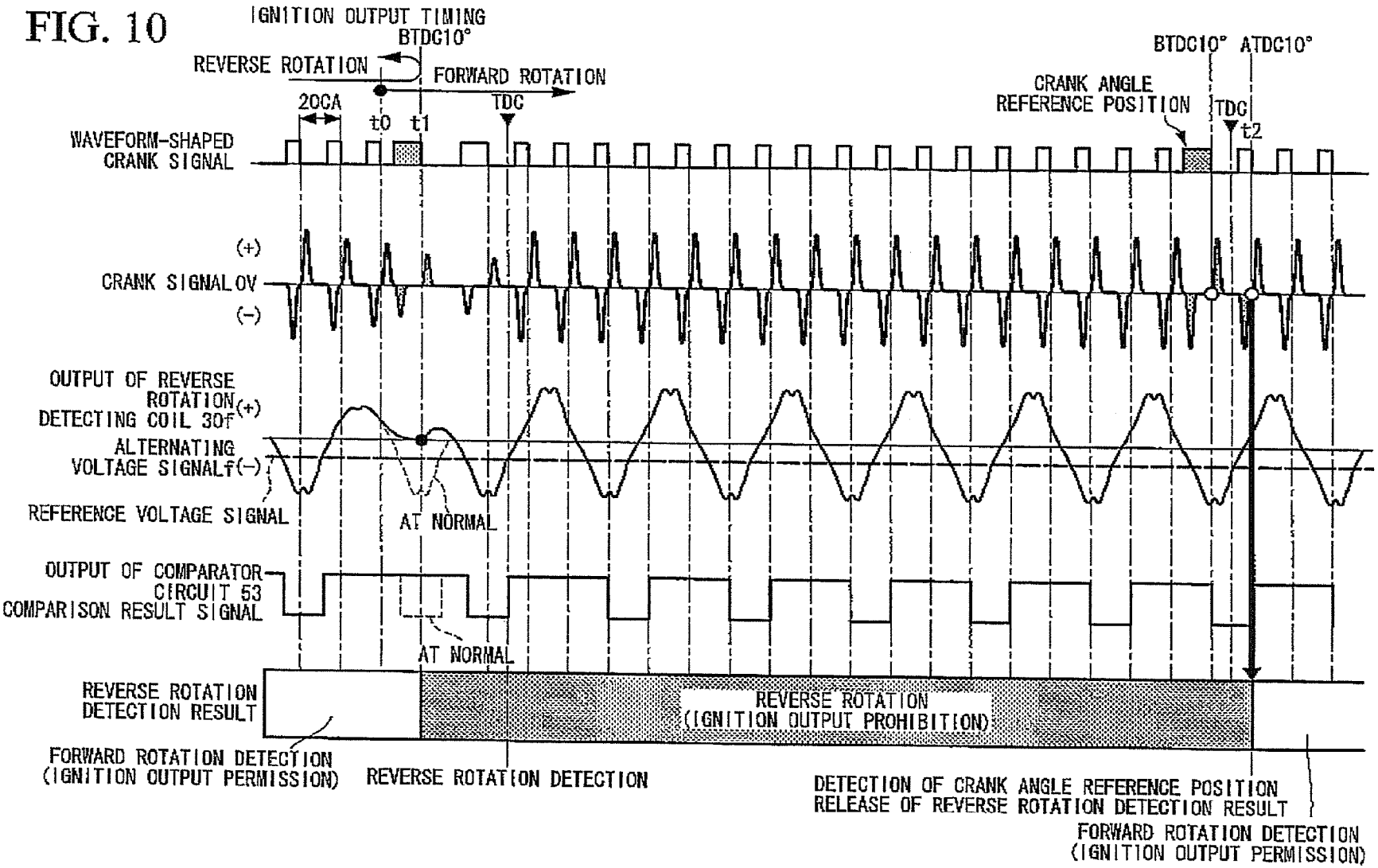
FIG. 10 is an explanatory diagram relating to the operation of a control apparatus for an internal combustion engine (ECU 4) according to a second embodiment of the invention.

FIG. 10 is a timing chart showing the correspondence relationship among crank signals output from the crank angle sensor 27, waveform-shaped crank signals output from the waveform shaping circuit 50, alternating voltage signals output from the reverse rotation detecting coil 30*f*, reference voltage signals output from the reference voltage source 52, comparison result signals output from the comparator circuit 53, and reverse rotation detection results.

As shown in FIG. 10, during the operation of the engine 1, the rotor 30*a* also rotates in synchronization with the rotation of the crankshaft 13, and the crank angle sensor 27 outputs pulsed crank signals having a negative-polarity amplitude when the front end of each projection passes therethrough in the rotational direction, and outputs pulsed crank signals having a positive-polarity amplitude when the rear end of each projection passes therethrough in the rotational direction.

Furthermore, the waveform shaping circuit 50 outputs crank signals (square-wave pulse signals) the waveform of which has been shaped such that negative-polarity crank signals have a high level, and positive-polarity and ground-level crank signals have a low level.

That is, the time between falling edges of waveform-shaped crank signals is equivalent to the time which is taken for the crankshaft 13 to rotate 20°.

Furthermore, from the reverse rotation detecting coil 30*f*, alternating voltage signals in which the time which is taken for the rotor 30*a* (crankshaft 13) to rotate 60° becomes one cycle are output. From the comparator circuit 53, high-level comparison result signals are output when the voltage values of alternating voltage signals are greater than the voltage values of reference voltage signals (i.e., when the alternating voltage signals have a positive polarity), and low-level comparison result signals are output when the voltage values of the alternating voltage signals are less than the voltage values of reference voltage signals (i.e., when the alternating voltage signals have a negative polarity).

During the operation of the engine 1, the CPU 55 performs the reverse rotation release processing of the second embodiment on the basis of the waveform-shaped crank signals and comparison result signals as described above.

Figure 11:
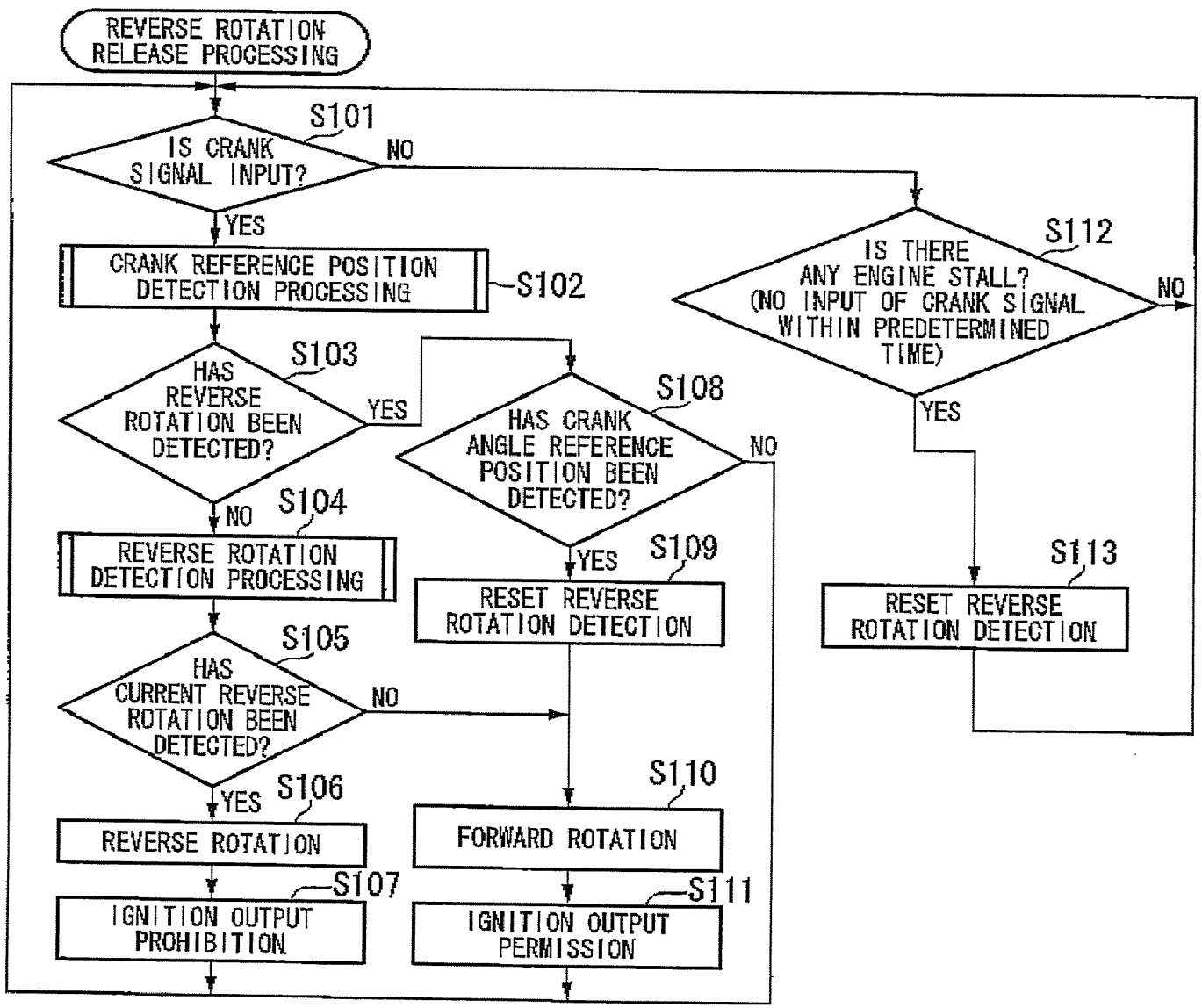
FIG. 11 is a flowchart relating to the operation of the control apparatus for an internal combustion engine (ECU 4) according to the second embodiment of the invention.

FIG. 11 is an operation flowchart of the CPU 55 relating to the reverse rotation release processing of the second embodiment.

As shown in FIG. 11, first, the CPU 55 determines whether or not a waveform-shaped crank signal has been input (Step S101). If the waveform-shaped crank signal has been input ("YES"), the CPU performs the crank angle reference position detection processing that is a subroutine (Step S102).

This crank angle reference position detection processing, which is the processing for detecting a crank angle reference position, can be detected on the basis of a crank signal generated when the crank angle reference projection 30$a_1$ passes through the crank angle sensor 27.

Hereinafter, the principle of this crank angle reference position detection processing will be described in detail with reference to FIGS. 12A and 12B.

Figure 12A:
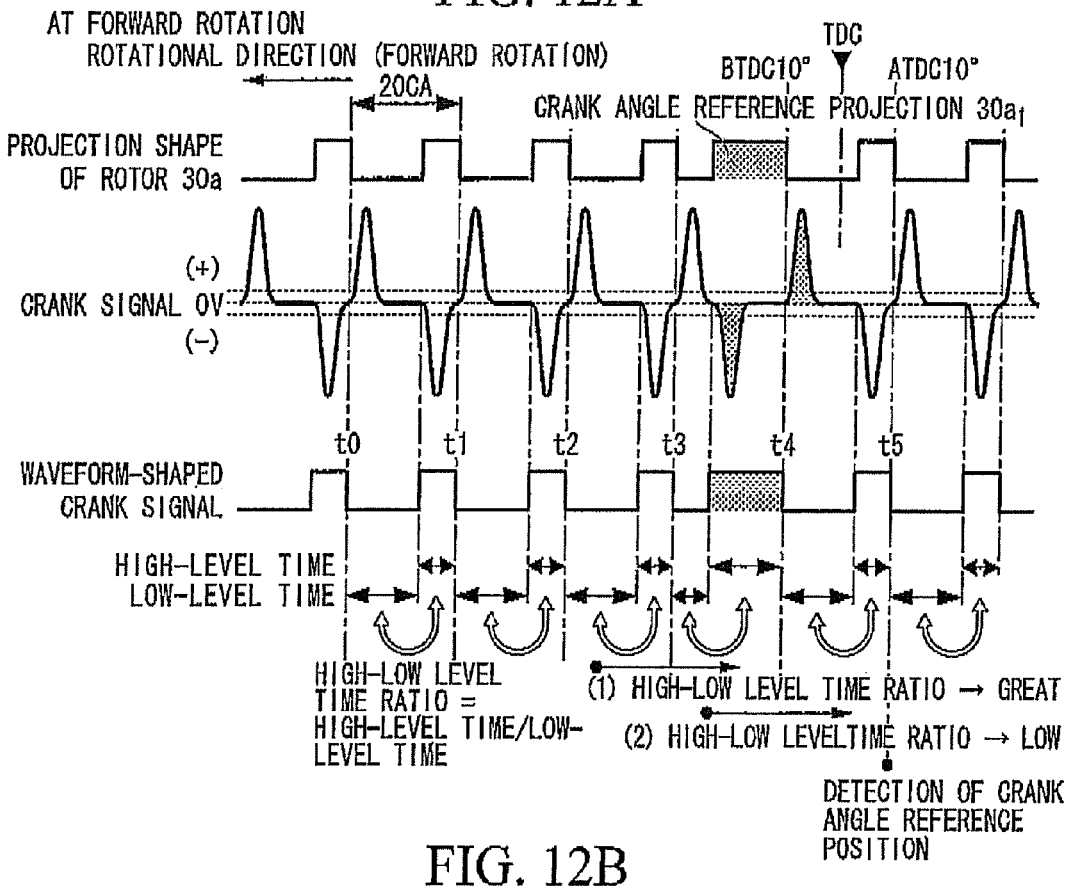
FIGS. 12A and 12B are explanatory diagrams relating to the operation of the control apparatus for an internal combustion engine (ECU 4) according to the second embodiment of the invention.

FIG. 12A is a timing chart showing the correspondence relationship among the arrangement of individual projections of the rotor 30*a*, crank signals, and waveform-shaped crank signals, at the time of forward rotation.

Figure 12B:
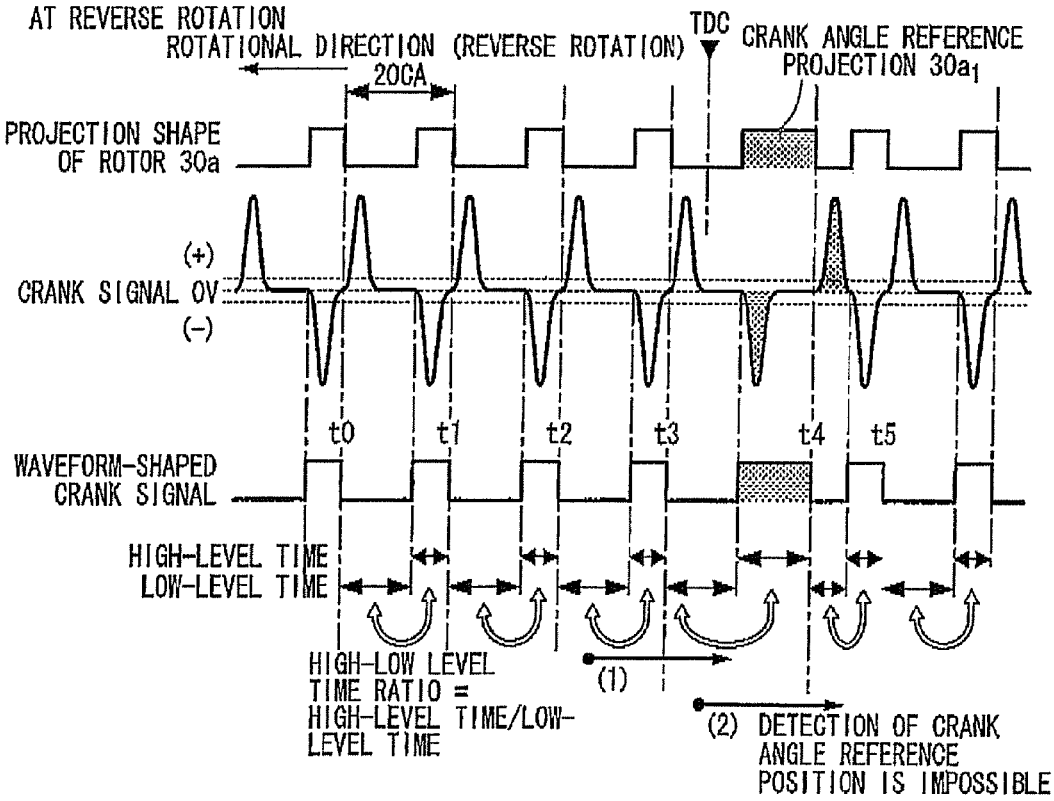

FIG. 12B is a timing chart showing the correspondence relationship among the arrangement of individual projections of the rotor 30*a*, crank signals, and waveform-shaped crank signals, at the time of reverse rotation.

In FIGS. 12A and 12B, a high-level period of a waveform-shaped crank signal is referred to as "high-level time", a low-level period is referred to as "low-level time", and the value represented by the high-level time divided by the low-level time is referred to as a "high-low time ratio".

As shown in FIG. 12A, at the time of forward rotation, in a period of points of t0 to t2 in which auxiliary projections 30$a_2$ are adjacent to each other, the high-low time ratio (i.e., previous high-low time ratio) of a period of points of t0 to t1 and the high-low time ratio (i.e., current high-low time ratio) of a period of points of t1 to t2 become the same value.

For example, if the high-level time is set to "1" and the low-level time is set to "2", both the previous high-low time ratio and the high-low time ratio become 1/2=0.5.

On the other hand, in a period of points of t2 to t4 in which an auxiliary projection 30$a_2$ precedes in the rotational direction, and a crank angle reference projection 30$a_1$ is adjacent to the rear of the auxiliary projection, the high-low time ratio (i.e., previous high-low time ratio) of a period of points of t2 to t3 corresponding to the auxiliary projection 30$a_2$ becomes 1/2=0.5 similarly to the above. However, the high-low time ratio (i.e., current high-low time ratio) of a period of points of t3 to t4 corresponding to the crank angle reference projection 30$a_1$ becomes longer in the high-level time than in the low-level time. Therefore, the high-low time ratio corresponding to the auxiliary projection 30$a_2$ becomes greater.

For example, if the high-level time of the period of points of t3 to t4 corresponding to the crank angle reference projection 30$a_1$ is set to "2" and the low-level time is set to "1", the high-low time ratio becomes 2/1=2.

That is, in the period of points of t2 to t4, the current high-low time ratio becomes greater than the previous high-low time ratio.

Furthermore, in a period of points of t3 to t5 in which the crank angle reference projection 30$a_1$ precedes in the rotational direction, and an auxiliary projection 30$a_2$ is adjacent to the rear of the crank angle reference projection, the high-low time ratio (i.e., previous high-low time ratio) of the period of points of t3 to t4 corresponding to the crank angle reference projection 30$a_1$ becomes 2/1=2 similarly to the above, and the high-low time ratio (i.e., current high-low time ratio) of a period of points of t4 to t5 corresponding to the auxiliary projection 30$a_2$ becomes 1/2=0.5 similarly to the above.

That is, in the period of points of t3 to t5, the current high-low time ratio becomes less than the previous high-low time ratio.

As understood from the above description, at the time of forward rotation, if the following Expression (1) is satisfied and the following Expression (2) is satisfied, it is possible to determine that the crank angle reference position has been detected, $$\text{"Current high-low time ratio"} - \text{"Previous high-low time ratio"} \geqq \text{"Determination threshold value } A\text{"} \quad (1)$$

$$\text{"Previous high-low time ratio"} - \text{"Current high-low time ratio"} \geqq \text{"Determination threshold value } B\text{"} \quad (2)$$

Here, the determination threshold values A (first threshold value) and B (second threshold value) are set to, for example, "1".

On the other hand, as shown in FIG. 12B, at the time of reverse rotation, in a period of points of t0 to t2 in which auxiliary projections 30$a_2$ are adjacent to each other, similarly to the forward rotation, the high-low time ratio (i.e., previous high-low time ratio) of a period of points of t0 to t1 and the high-low time ratio (i.e., current high-low time ratio) of a period of points of t1 to t2 become the same value.

However, at the time of reverse rotation, in a period of points of t2 to t4 in which an auxiliary projection 30$a_2$ precedes in the rotational direction, and a crank angle reference projection 30$a_1$ is adjacent to the rear of the auxiliary projection, the high-low time ratio (i.e., previous high-low time ratio) of a period of points of t2 to t3 corresponding to the auxiliary projection 30$a_2$ becomes 1/2=0.5 similarly to the above. However, the high-low time ratio (i.e., current high-low time ratio) of a period of points of t3 to t4 corresponding to the crank angle reference projection 30$a_1$ becomes less compared with that at the time of forward rotation because the high-level time and the low-level time almost coincide with each other.

For example, if the high-level time of the period of points of t3 to t4 corresponding to the crank angle reference projection 30$a_1$ at the time of reverse rotation is set to "2" and the low-level time is set to "2", the high-low time ratio becomes 2/2=1.

That is, in the period of points of t2 to t4 at the time of reverse rotation, the above Expression (1) is not satisfied.

Moreover, at the time of reverse rotation, in a period of points of t3 to t5 in which the crank angle reference projection 30$a_1$ precedes in the rotational direction, and an auxiliary projection 30$a_2$ is adjacent to the rear of the crank angle reference projection, the high-low time ratio (i.e., previous high-low time ratio) of the period of points of t3 to t4 corresponding to the crank angle reference projection 30$a_1$ becomes 2/2=1 similarly to the above. However, the high-low time ratio (i.e., current high-low time ratio) of a period of points of t4 to t5 corresponding to the auxiliary projection 30$a_2$ becomes greater compared with that at the time of forward rotation because the high-level time and the low-level time almost coincide with each other.

For example, if the high-level time of the period of points of t4 to t5 corresponding to the auxiliary projection 30$a_2$ at the time of reverse rotation is set to "1" and the low-level time is set to "1", the high-low time ratio becomes 1/1=1.

That is, in the period of points of t3 to t5 at the time of reverse rotation, the above Expression (2) is not satisfied.

As described above, when the previous high-low time ratio and current high-low time ratio of a waveform-shaped crank signal is used, the crank angle reference position can be detected at the time of forward rotation, and the crank angle reference position cannot be detected at the time of reverse rotation.

In other words, if the crank angle reference position can be detected, it is possible to determine that the engine 1 is in a forward rotation state.

Figure 13:
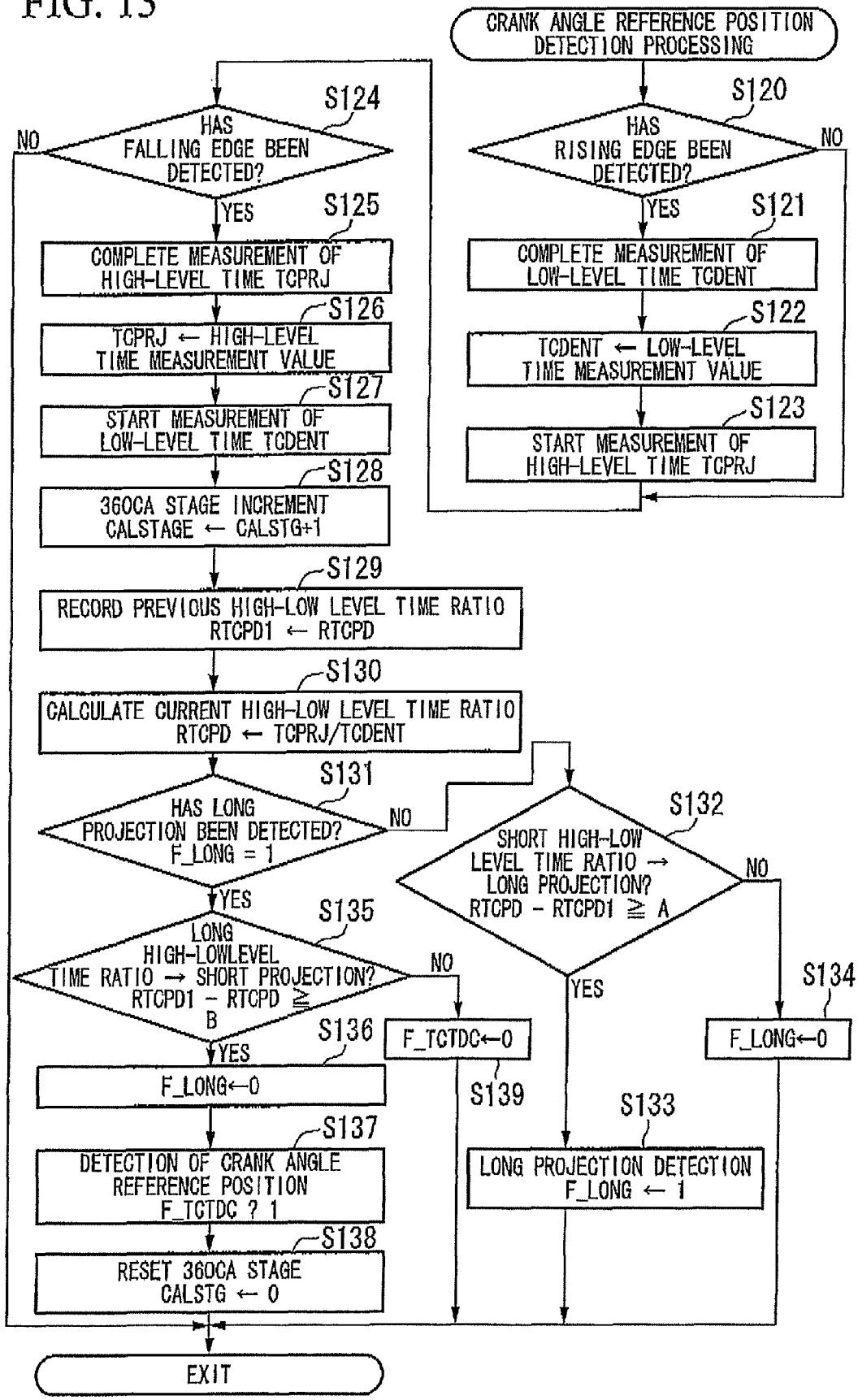
FIG. 13 is a flowchart relating to the operation of the control apparatus for an internal combustion engine (ECU 4) according to the second embodiment of the invention.

On the basis of the principle of the above crank angle reference position detection processing, the CPU 55 executes a subroutine of the crank angle reference position detection processing shown in FIG. 13, in Step S102 of FIG. 11.

In the crank angle reference position detection processing shown in FIG. 13, the CPU 55 first determines whether or not a rising edge of a waveform-shaped crank signal has been detected (Step S120). If the rising edge has been detected ("YES"), the CPU controls the timer 61 to complete measurement of a low-level time TCDENT (Step S121).

Then, the CPU 55 updates the value of "TCDENT", which is a variable showing a low-level time to a low-level time measurement value at the completion of Step S121 (Step S122), and starts measurement of a high-level time TCPRJ (Step S123).

On the other hand, if, in Step S120, the rising edge is not detected ("NO"), the CPU 55 proceeds to the processing of Step S124.

Subsequently, the CPU 55 first determines whether or not a falling edge of a waveform-shaped crank signal has been detected (Step S124). If the falling edge has been detected ("YES"), the CPU controls the timer 61 to complete measurement of a high-level time TCPRJ (Step S125).

On the other hand, if, in Step S124, the falling edge is not detected ("NO"), the CPU 55 completes the crank angle reference position detection processing, and proceeds to the processing of Step S103 in FIG. 11.

After the completion of Step S125, the CPU 55 updates the value of "TCPRJ", which is a variable showing a high-level time to a high-level time measurement value at the completion of Step S125 (Step S126), and starts measurement of the low-level time TCDENT (Step S127).

Then, the CPU 55 executes an increment of a 360 CA stage CALSTG, which is a variable showing that the rotor 30*a* (i.e., crankshaft 13) has rotated 20° (Step S128).

That is, whenever the crankshaft 13 rotates 20° (whenever a falling edge of a waveform-shaped crank signal is detected), the value of the 360 CA stage CALSTG increases one by one, and if the crankshaft makes one rotation ((360° rotation), CALSTG=17 is satisfied.

Then, the CPU 55 updates the value of a previous high-low time ratio RTCPD1 to the value of a current high-low time ratio RTCPD at the present time (Step S129), and newly calculates the current high-low time ratio RTCPD (Step S130).

Here, the calculational expression of the current high-low time ratio RTCPD becomes the following Expression (3).

$$\text{"Current high-low time ratio } RTCPD\text{"}=\text{"High-level time } TCPRJ\text{"}/\text{"Low-level time } TCDENT\text{"} \quad (3)$$

Then, the CPU 55 determines whether or not the crank angle reference projection $\mathbf{30}a_1$ has been detected (Step S131).

Specifically, if the crank angle reference projection $\mathbf{30}a_1$ has been detected at this time, reference projection detection flag F_LONG=1 is satisfied. Therefore, in Step S131, the CPU 55 determines whether or not the reference projection detection flag F_LONG=1 is satisfied.

In this Step S131, if the reference projection detection flag F_LONG is other than "1" ("NO") (i.e., if the rank angle reference projection $\mathbf{30}a_1$ is not detected), the CPU 55 determines whether or not the above Expression (1) is satisfied, i.e., whether or not a value obtained by subtracting the previous high-low time ratio RTCPD1 from the current high-low time ratio RTCPD is greater than or equal to the determination threshold value A (Step S132).

If the above Expression (1) is satisfied ("YES") in this Step S132, the CPU 55 determines that the crank angle reference projection $\mathbf{30}a_1$ has been detected, to set the reference projection detection flag F_LONG=1, and then completes the crank angle reference position detection processing, and proceeds to the processing of Step S103 of FIG. 11 (Step S133).

On the other hand, if, in Step S132, the above Expression (1) is not satisfied ("NO"), the CPU 55 sets the reference projection detection flag F_LONG=0 (Step S134), and then completes the crank angle reference position detection processing, and proceeds to the processing of Step S103 of FIG. 11.

Furthermore, in the above Step S131, in the, case of the reference projection detection flag F_LONG=1, i.e., if the above Expression (1) is satisfied, and the crank angle reference projection $\mathbf{30}a_1$ has been detected ("YES"), the CPU 55 determines whether or not the above Expression (2) is satisfied, i.e., whether or not a value obtained by subtracting the current high-low time ratio RTCPD from the previous high-low time ratio RTCPD1 is greater than or equal to the determination threshold value, (Step S135).

If the above Expression (2) is satisfied ("YES") in this Step S135, the CPU 55 resets the reference projection detection flag F_LONG to "0" (Step S136), and determines that the crank angle reference position has been detected, to set the reference position detection flag F_TCTDC=1 (Step S137).

Then, the CPU 55 resets the 360 CA stage CALSTG to "0" (Step S138), and completes the crank angle reference position detection processing, and proceeds to the processing of Step S103 of FIG. 11.

On the other hand, if, in Step S135, the above Expression (2) is not satisfied ("NO"), the CPU 55 sets the reference position detection flag F_TCTDC=0, and then completes the crank angle reference position detection processing, and proceeds to the processing of Step S103 of FIG. 11 (Step S139).

The above description is about the crank angle reference position detection processing, and a description will be made below referring back to FIG. 11.

The CPU 55 performs the processing of Step S103 of FIG. 11 if the above crank angle reference position detection processing is completed.

Here, the CPU 55 determines whether or not the reverse rotation has been detected (Step S103). If the detection of the reverse potation is not detected ("NO"), the CPU performs the reverse rotation detection processing (Step S104).

As the reverse rotation detection processing performed in this Step S104, already well-known techniques as described in, for example, Japanese Patent No. 2780257, Japanese Unexamined Patent Application, First Publication No. S62-75075, Japanese Patent No. 3375679, and Japanese Unexamined Patent Application, First Publication No. 2005-220866, can be used.

In the second embodiment, the technique of Japanese Patent No. 2780257 is adopted.

Specifically, as shown in FIG. 10, assuming that reverse rotation is generated at the point of time t0 and then a return to forward rotation has been made, if the engine is in originally forward rotation, the polarity of an alternating voltage signal output from the reverse rotation detecting coil 30*f* at the point of time t1 becomes a negative polarity, and consequently the comparison result signal will have a low level (refer to a wave-like broken line portion). However, at the generation of reverse rotation, the alternating voltage signal becomes a positive polarity at the point of time t1, and consequently, the comparison result signal will have a high level.

That is, the generation of reverse rotation can be detected by determining whether or not the correspondence relationship between a falling edge of a waveform-shaped crank signal detected with a predetermined timing (a falling edge corresponding to the crank angle reference projection 30$a_1$ in the second embodiment), and the level polarity of an alternating voltage signal) of a comparison result signal coincides with that at the time of forward rotation.

The CPU 55 performs the reverse rotation detection processing by such a technology, and determines whether or not the generation of current reverse rotation has been detected (Step S105).

If, in this Step S105, the generation of current reverse rotation has been detected ("YES"), the CPU 55 determines that the engine 1 is in a reverse rotation state (Step S106), and proceeds to an ignition output prohibition mode (output prohibition of an ignition control signal) (Step S107).

In the example of FIG. 10, the CPU proceeds to the ignition output prohibition mode at the point of time t1 when reverse rotation has been detected.

Thereafter, the CPU 55 returns to the processing of Step S101.

On the other hand, if, in Step S105, the generation of current reverse rotation is not detected ("NO"), the CPU 55 proceeds to the processing of Step S110.

On the other hand, if reverse rotation has been detected ("YES") in Step S103, the CPU 55 determines whether or not the crank angle reference position has been detected, i.e., whether or not the reference position detection flag F_TCDC=1 (Step S108) is satisfied. If the crank angle reference position has been detected ("YES"), the CPU resets the reverse rotation detection result to release the ignition output prohibition mode (Step S109).

That is, as described above, since it is possible to determine that the engine 1 is in a forward rotation state by the fact that the crank angle reference position can be detected, the ignition output prohibition mode does not need to be continued.

In the example of FIG. 10, since it is determined that the crank angle reference position has been detected at the point of time t2 (a point of time when a falling edge of a waveform-shaped crank signal corresponding to ATDC 10° has been detected), the ignition output prohibition mode is released at this time.

Then, the CPU 55 determines that the engine 1 is in a forward rotation state (Step S110), and proceeds to a normal ignition output permission mode (whenever the ignition timing arrives, an ignition control signal is output to the ignition circuit 56) (Step S111).

In the example of FIG. 10, the CPU proceeds to the ignition output permission mode after the point of time t2.

The CPU 55 returns to the processing of Step S101 if the crank angle reference position is not detected ("NO") after this Step S111 or in Step S108.

Furthermore, if, in Step S101, any waveform-shaped crank signal is not input ("NO"), the CPU 55 controls the timer 61 to determine whether or not there is no input (engine stall) of a waveform-shaped crank signal within predetermined time (Step S112).

If there is any input of a waveform-shaped crank signal within predetermined time in this Step S112, i.e., if there is no engine stall ("NO"), the CPU 55 returns to the processing of Step S101.

On the other hand, if, in Step S112, there is no input of a waveform-shaped crank signal within a predetermined time ("YES") (i.e., if it is determined to be an engine stall), the CPU resets the reverse rotation detection result to release the ignition output prohibition mode and return to the processing of Step S101 (Step S113).

As described above, according to the second embodiment, return of the engine 1 to the forward rotation is determined after the detection of reverse rotation, and the reverse rotation detection result is reset to release the ignition output prohibition mode. Thereby, even if a starter motor or a manual startup device (kick pedal, etc.) is continuously operated after the detection of reverse rotation, the ignition output prohibition mode can be released to prevent startup from being disabled.

Furthermore, since the reverse rotation detection result is reset and the ignition output prohibition mode is not released at the time of reverse rotation, any damage of startup drive system parts, such as starter idle gears, or an engine body can be prevented.

Next, a third embodiment of the invention will be described.

In the reverse rotation release processing in the third embodiment, a case where 720° engine stroke determination has been completed after the detection of reverse rotation is determined to be returned to a forward rotation state, and the reverse rotation detection result (ignition output prohibition) is released.

In addition, in the following third embodiment, the same components as those of the above first and second embodiments are denoted by the same reference numerals, and the description thereof is omitted.

It is to be noted in the following description that the structure of the rotor 30*a* differs from that of the above second embodiment.

Figure 14:
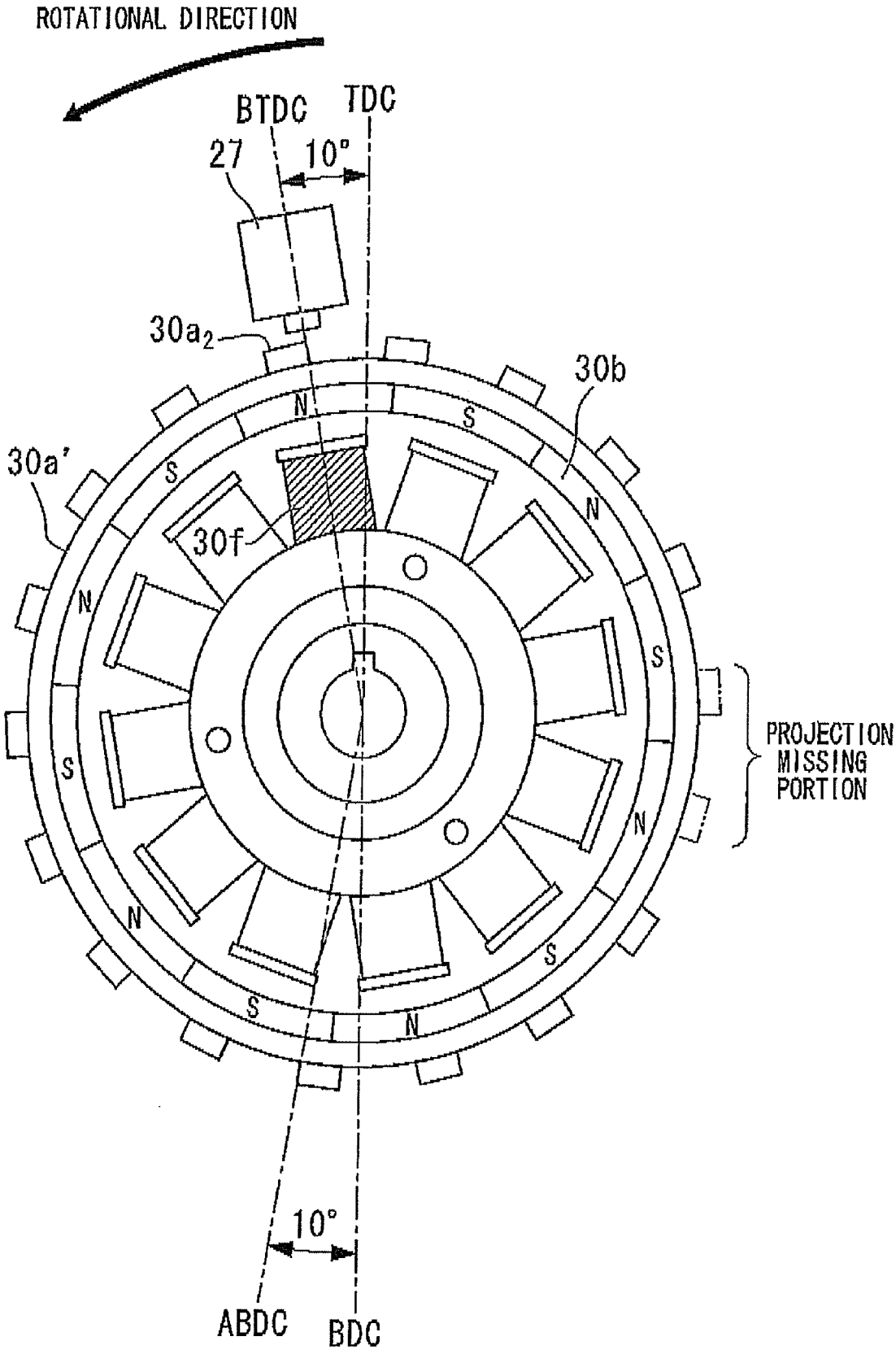
FIG. 14 is a detailed explanatory diagram of a rotor 30*a* constituting a generator 30 according to a third embodiment of the invention.

That is, as shown in FIG. 14, a rotor 30*a*' used in the third embodiment has a structure in which auxiliary projections 30$a_2$ are provided instead of the crank angle reference projections 30$a_1$, and the auxiliary projections 30$a_2$ that were provided in 70° and 90° positions backward from a top dead center TDC in the rotational direction are eliminated.

In the rotor 30*a*' used in such a third embodiment, a missing portion of the auxiliary projection 30$a_2$ is used in order to detect a crank angle reference position.

Accordingly, in the second embodiment, the crank angle reference position (this position is also a position that specifies ignition timing) is set to a 10° position forward from the top dead center TDC in the rotational direction of the rotor 30*a*. However, in the third embodiment, the 10° position forward from the top dead center TDC is defined as an ignition reference position that specifies only ignition timing in the rotational direction of the rotor 30*a*'.

Furthermore, in the third embodiment, as shown in FIG. 14, the 10° position backward from a bottom dead center BDC is defined as an intake pressure detection position in the rotational direction of rotor 30*a*'.

Figure 15:
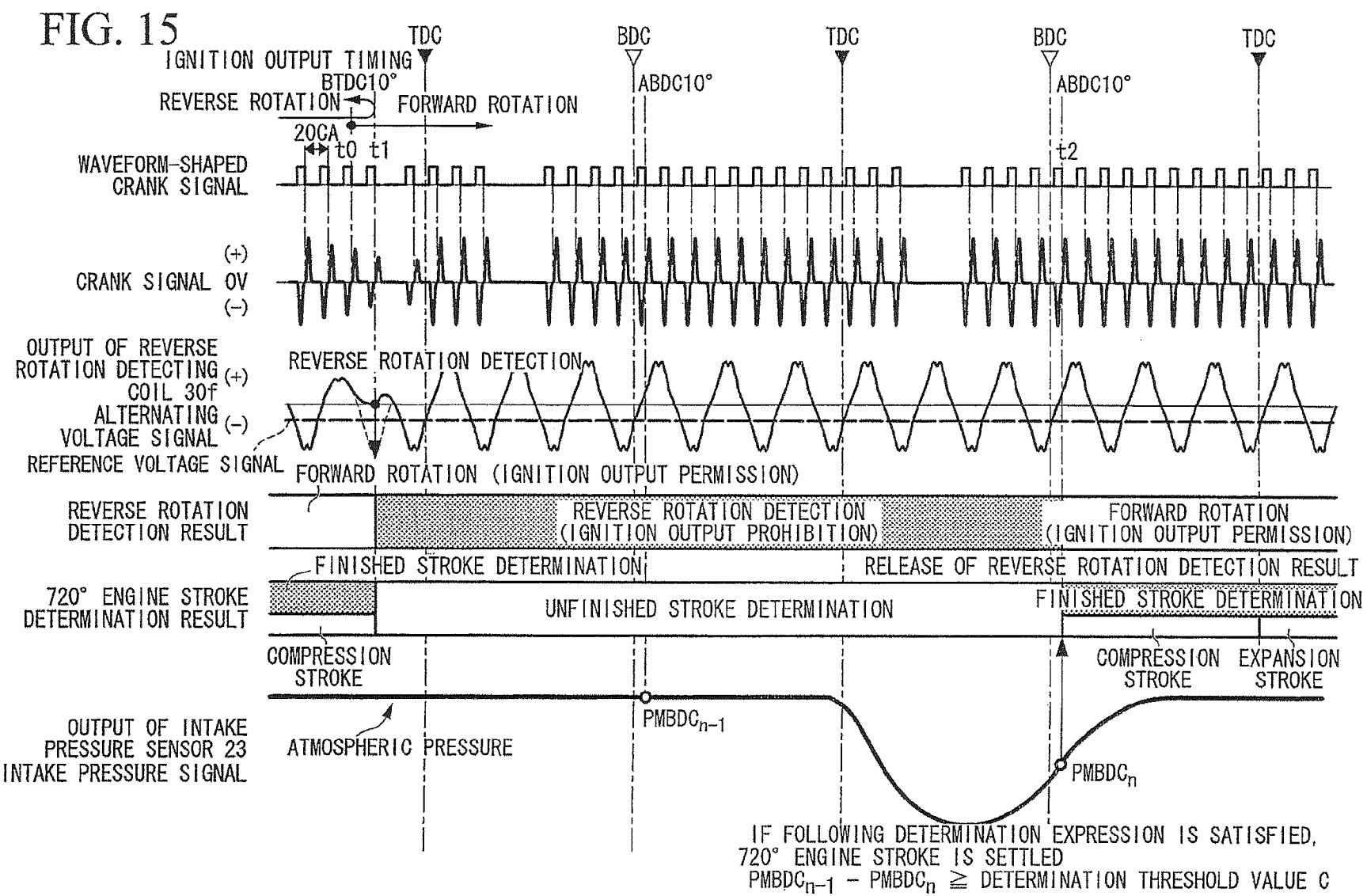
FIG. 15 is an explanatory diagram relating to the operation of a control apparatus for an internal combustion engine (ECU 4) according to the third embodiment of the invention.

FIG. 15 is a timing chat showing the correspondence relationship among crank signals output from the crank angle sensor 27, waveform-shaped crank signals output from the waveform shaping circuit 50, alternating voltage signals output from the reverse rotation detecting coil 30*f*, reference voltage signals output from the reference voltage source 52, reverse rotation detection results, 720° engine stroke determination results, and intake pressure signals output from the intake pressure sensor 23.

The third embodiment shown in FIG. 15 is different from the second embodiment (FIG. 10) in that, in a period (period corresponding to a crank angle reference position) corresponding to a projection missing portion in the rotor 30*a*', there is no input (ground level) of a crank signal and a waveform-shaped crank signal, and after the detection of reverse rotation, the 720° engine stroke is determined on the basis of an intake pressure signal, a case where the stroke determination is completed is determined to be returned to a forward rotation state, the reverse rotation detection result is reset, and the ignition output prohibition mode is released.

Here, in the case of a four-cycle engine, four strokes including intake, compression, expansion (combustion), exhaust are repeated in order whenever the crankshaft 13 makes two rotations (720° rotation).

The above 720° engine stroke determination means that engine stroke determination is completed by determining the intake stroke of the four strokes.

Hereinafter, the third embodiment of this reverse rotation release processing will be described in detail with reference to the flowchart of FIG. 16.

Figure 16:
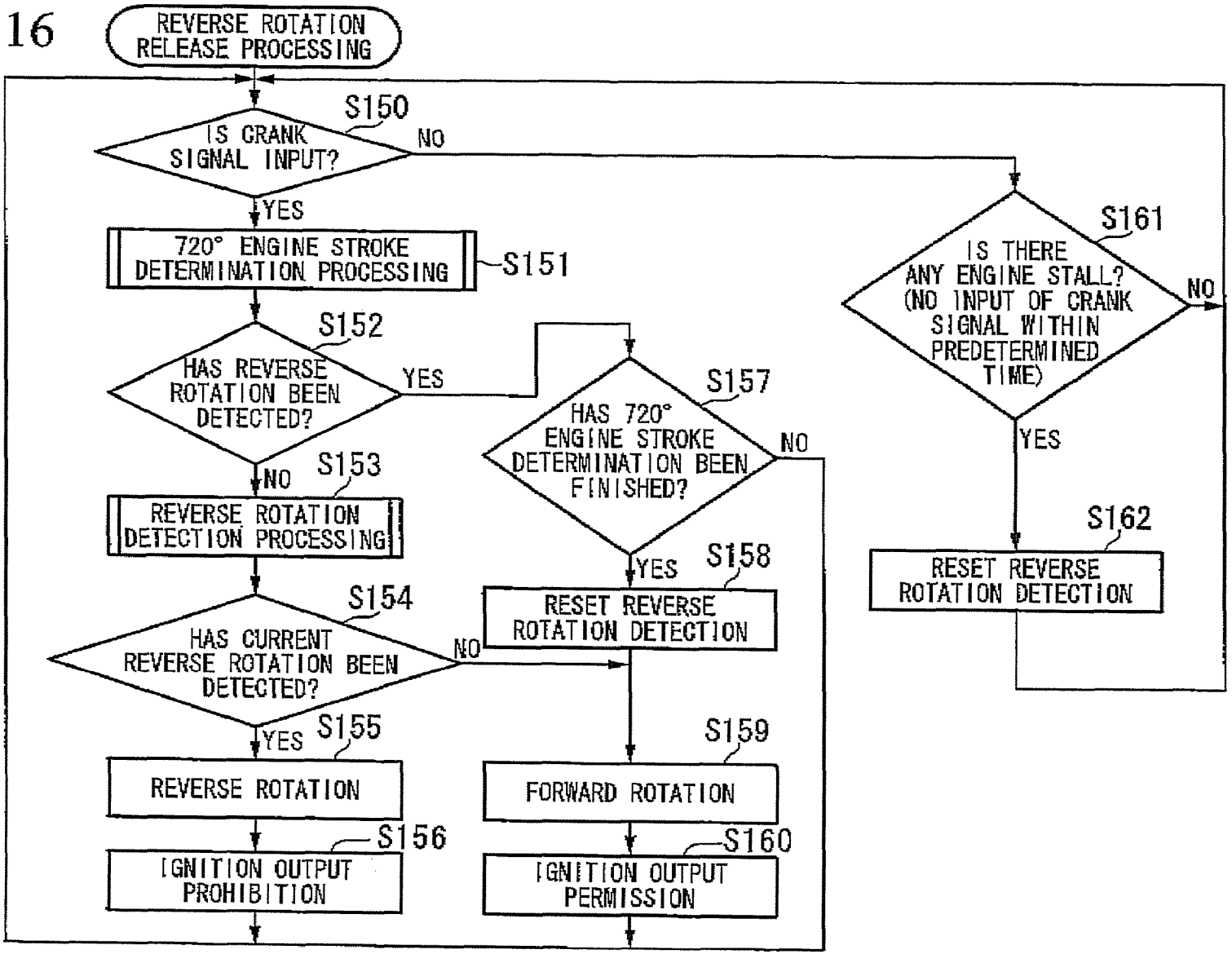
FIG. 16 is a flowchart relating to the operation of the control apparatus for an internal combustion engine (ECU 4) according to the third embodiment of the invention.

FIG. 16 is an operation flowchart of the CPU 55 relating to the reverse rotation release processing of the third embodiment.

As shown in FIG. 16, first, the CPU 55 determines whether or not a waveform-shaped crank signal has been input (Step S150). If the waveform-shaped crank signal has been input ("YES"), the CPU performs the 720° engine stroke determination processing that is a subroutine (Step S151).

This 720° engine stroke determination processing means that engine stroke determination is completed by determining an intake stroke of four strokes. This intake stroke can be determined according to the change of an intake pressure signal.

Hereinafter, the principle of this 720° engine stroke determination processing will be described in detail with reference to FIGS. 17A, 17B, and 18.

Figure 17A:
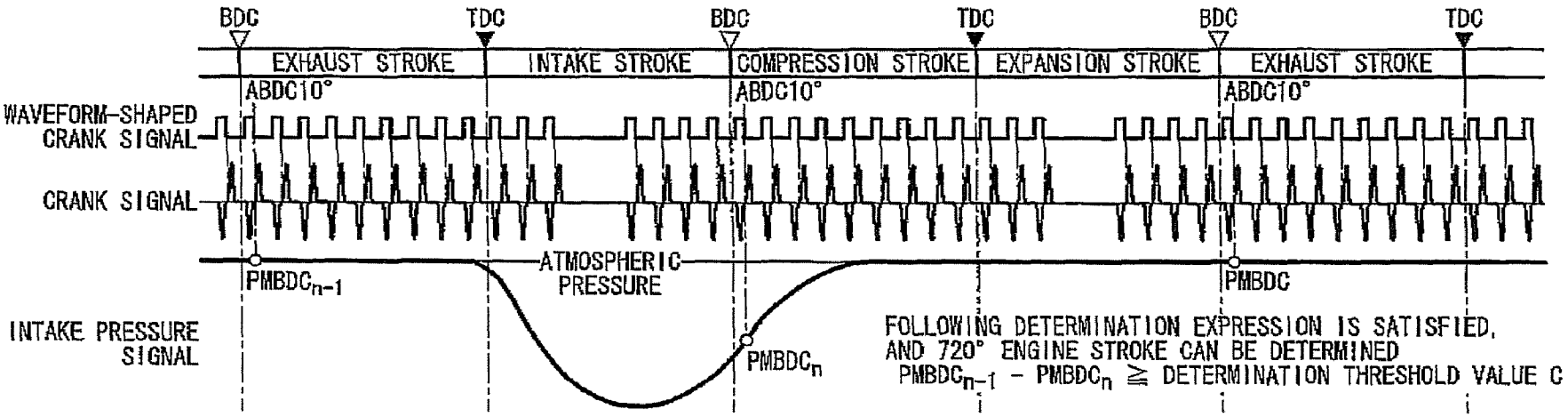
FIGS. 17A and 17B are explanatory diagrams relating to the operation of the control apparatus for an internal combustion engine (ECU 4) according to the third embodiment of the invention.

FIG. 17A is a timing chart showing the correspondence relationship among crank signals, and waveform-shaped crank signals, and intake pressure signal, at the time of forward rotation.

Figure 17B:
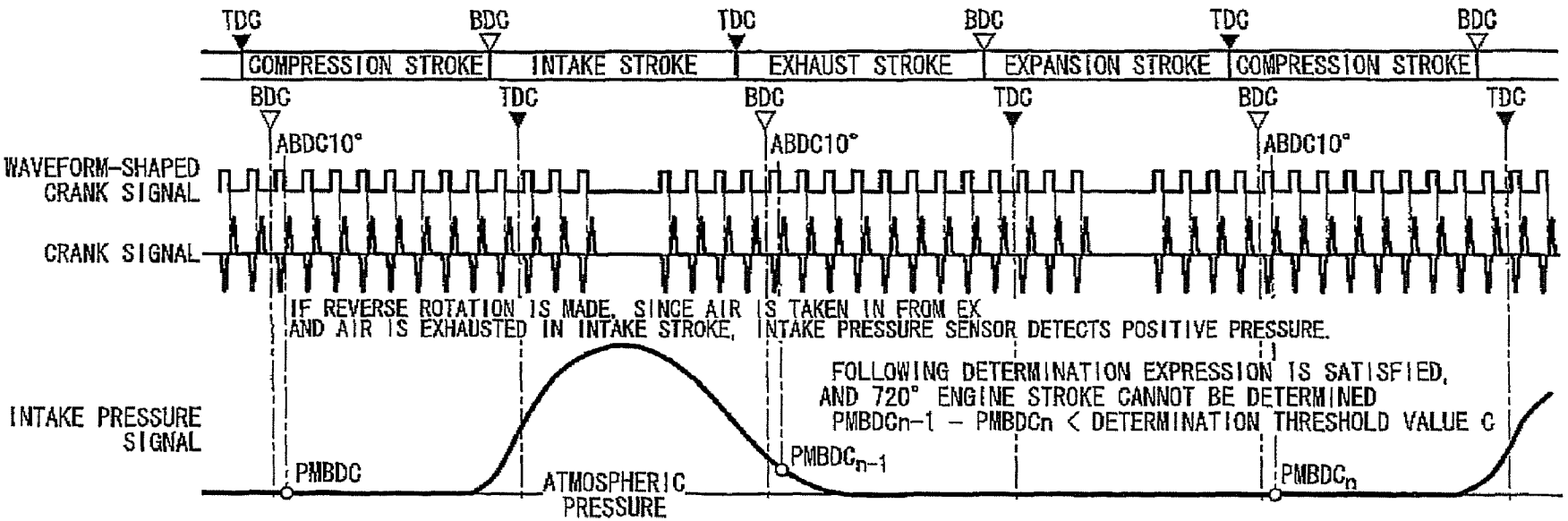

FIG. 17B is a timing chart showing the correspondence relationship among crank signals, waveform-shaped crank signals, and intake pressure signals, at the time of reverse rotation.

Figure 18:
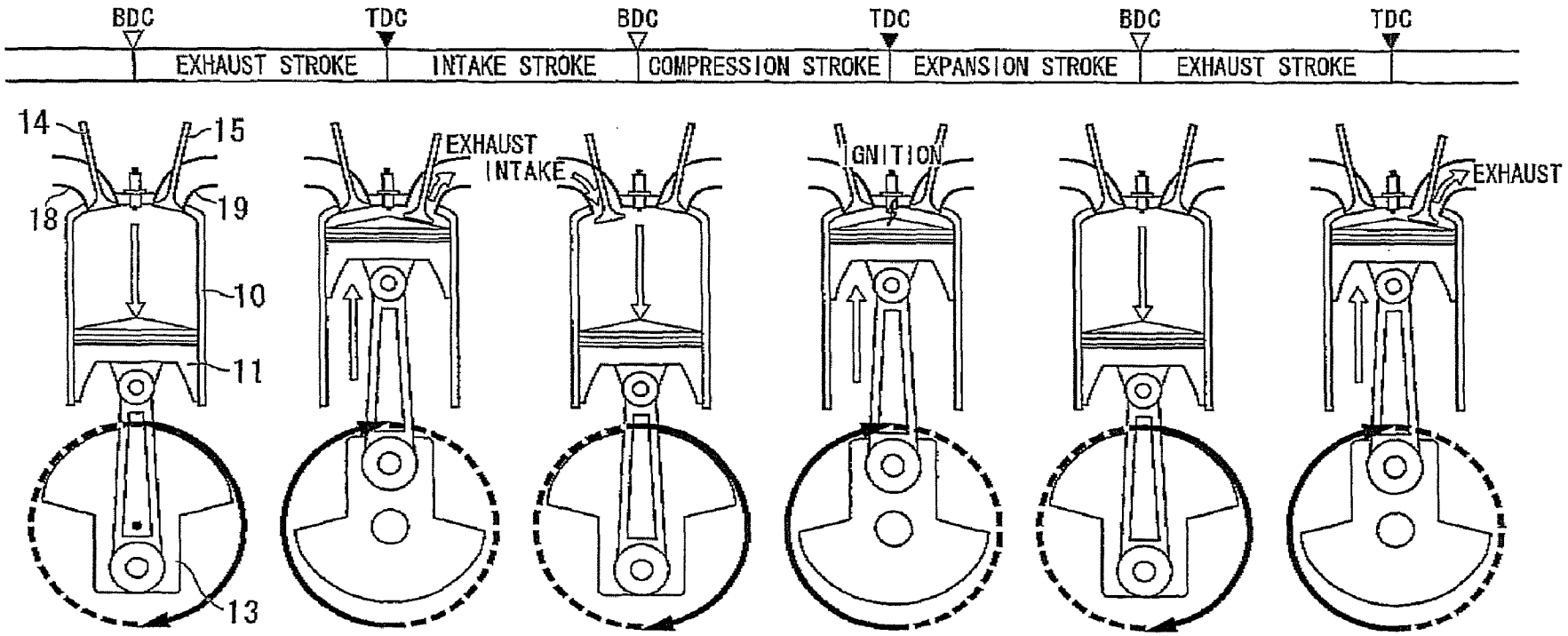
FIG. 18 is an explanatory diagram relating to the operation of the control apparatus for an internal combustion engine (ECU 4) according to the third embodiment of the invention.

FIG. 18 shows the position of the piston 11 at the top dead center TDC and bottom dead center BDC of each stroke, and an opening/closing state of an intake valve 14 and an exhaust valve 15, at the time of forward rotation.

As shown in FIG. 18, in an intake stroke at the time of forward rotation, the intake valve 14 is in an open state, and the piston 11 descends toward the bottom dead center BDC.

As a result, since negative pressure is generated within an intake pipe 18, as shown in FIG. 17A, the intake pressure becomes less than the atmospheric pressure.

Accordingly, if the intake pressure detected at every predetermined crank angle (intake pressure detection position in the third embodiment) satisfies the following Expression (4), it is possible to determine that a current engine stroke is the intake stroke.

In addition, in the following Expression (4), a determination threshold value C is equivalent to a third threshold value of the invention.

"Previous intake pressure *PMBDCn*−1"−"Current intake pressure *PMBDCn*"≧"Determination threshold value *C*" (4)

On the other hand, at the time of reverse rotation, air is taken in from an exhaust pipe 19 in an exhaust stroke, and air is exhausted to the intake pipe 18 in the intake stroke. Therefore, as shown in FIG. 17B, the intake pressure becomes a positive pressure (becomes greater than the atmospheric pressure).

Accordingly, at the time of reverse rotation, the above Expression (4) is not satisfied.

In other words, if the above Expression (4) is satisfied, it is possible to determine that the engine 1 is in a forward rotation state.

Figure 19:
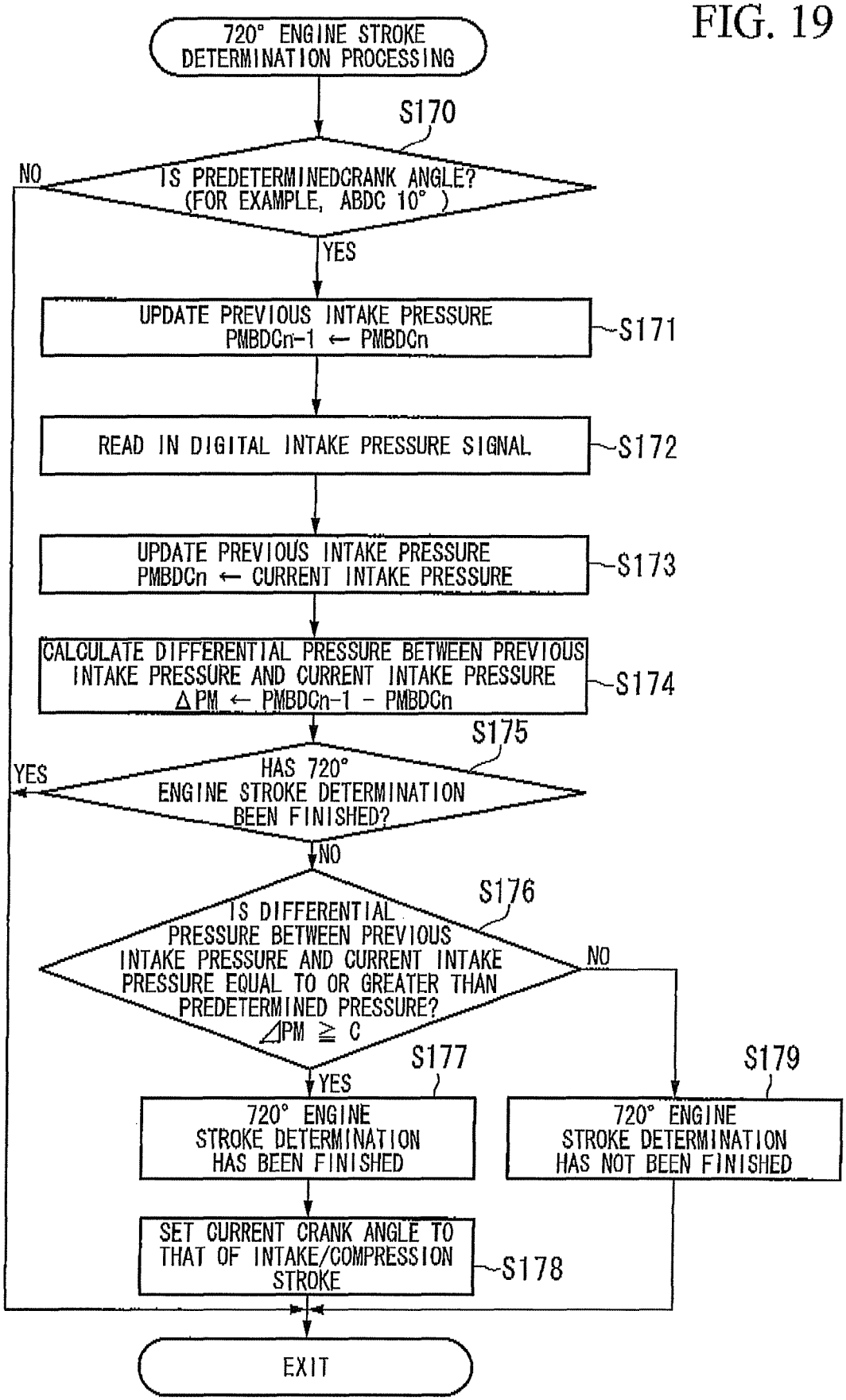
FIG. 19 is a flowchart relating to the operation of the control apparatus for an internal combustion engine (ECU 4) according to the third embodiment of the invention.

On the basis of the principle of the above 720° engine stroke determination processing, the CPU 55 executes a subroutine of the 720° engine stroke determination processing shown in FIG. 19, in Step S151 of FIG. 16.

In the 720° engine stroke determination processing shown in FIG. 19, first, the CPU 55 determines whether or not there is a predetermined crank angle (the intake pressure detection position has been detected) (Step S170). If the intake pressure detection position is not detected ("NO"), the CPU completes the 720-degree engine stroke determination processing, and proceeds to the processing of Step S152 of FIG. 16.

On the other hand, if, in Step S170, the intake pressure detection position has been detected ("YES"), the CPU 55 updates the value of a previous intake pressure PMBDCn−1 to the value of a current intake pressure PMBDCn (Step S171), and reads in a digital intake pressure signal from an A/D converter 54 (Step S172).

Then, the CPU 55 calculates an intake pressure on the basis of the digital intake pressure signal to set the calculated intake pressure to the current intake pressure PMBDCn (Step S173), and calculates a differential pressure ΔPM (=PMBDCn−1 PMBDCn) between the previous intake pressure PMBDCn−1 and the current intake pressure PMBDCn (Step S174).

Then, the CPU 55 determines whether the 720° engine stroke has been determined (Step S175). If the determination is finished ("YES"), the CPU completes the 720° engine stroke determination processing to proceeds to the processing of Step S152 of FIG. 16. On the other hand, if the determination is not finished ("NO"), the CPU determines whether or not the above Expression (4) is satisfied, using the differential pressure ΔPM calculated in the above Step S174 (Step S176).

If, in this Step S176, the above Expression (4) is satisfied ("YES") (i.e., if it is determined that a current engine stroke is the intake stroke), the CPU 55 determines that the 720° engine stroke determination is finished (Step S177), and sets the current crank angle to the crank angle in the intake/compression stroke (Step S178).

On the other hand, if, in Step S176, the above Expression (4) is not satisfied ("NO") (i.e., if it is determined that a current engine stroke is not the intake stroke), the CPU 55 completes the 720° engine stroke determination processing, and proceeds to the processing of Step S152 of FIG. 16.

The above description is the description about the 720° engine stroke determination processing, and description will be made below referring back to FIG. 16.

The CPU 55 performs the processing of Step S152 of FIG. 16 if the above 720° engine stroke determination processing is completed.

Here, the CPU 55 determines whether or not the reverse rotation has been detected (Step S152). If the detection of the reverse rotation is not detected ("NO"), the CPU performs the reverse rotation detection processing (Step S153).

The reverse rotation detection processing in this Step S152 is the same as that of the second embodiment.

That is, in FIG. 15, assuming that reverse rotation is generated at the point of time t0 and then return to forward rotation has been made, the generation of reverse rotation is detected by determining whether or not the correspondence relationship between a falling edge of a waveform-shaped crank signal detected at a point of time t1, and the level (polarity of an alternating voltage signal) of a comparison result signal coincides with that at the time of forward rotation.

The CPU 55 performs the reverse rotation detection processing by such a technology, and determines whether or not the generation of current reverse rotation has been detected (Step S154).

If, in this Step S154, the generation of current reverse rotation has been detected ("YES"), the CPU 55 determines that the engine 1 is in a reverse rotation state (Step S155), and proceeds to an ignition output prohibition mode (output prohibition of an ignition control signal) (Step S156).

In the example of FIG, 15, the CPU proceeds to the ignition output prohibition mode at the point of time t1 when reverse rotation has been detected.

Furthermore, at this time, the 720° engine stroke determination result becomes incomplete stroke determination.

The CPU 55 returns to the processing of Step S150 after Step S156.

On the other hand, if, in Step S154, the generation of current reverse rotation is not detected ("NO"), the CPU 55 proceeds to the processing of Step S159.

On the other hand, if reverse rotation has been detected ("YES") in Step S152, the CPU 55 determines whether or not the 720° engine stroke determination has been finished, i.e., whether or not intake stroke has been determined (Step S157). If the 720° engine stroke determination has been finished ("YES"), the CPU resets the reverse rotation detection result to release the ignition output prohibition mode (Step S158).

That is, as described above, since it is possible to determine that the engine 1 is in a forward rotation state by the fact that the 720° engine stroke can be detected, the ignition output prohibition mode does not need to be continued.

In the example of FIG. 15, since the above Expression (4) is satisfied at the point of time t2 and the intake stroke is determined, the ignition output prohibition mode is released at this time.

Then, the CPU 55 determines that the engine 1 is in a forward rotation state (Step S159), and proceeds to a normal ignition output permission mode (whenever the ignition timing arrives, an ignition control signal is output to the ignition circuit 56) (Step S160).

In the example of FIG. 15, the CPU proceeds to the ignition output permission mode after the point of time t2.

The CPU 55 returns to the processing of Step S150 if the 720° engine stroke determination is not detected ("NO") after this Step S160 or in Step S157.

Furthermore, if, in Step S150, any waveform-shaped crank signal is not input ("NO"), the CPU 55 controls the timer 61 to determine whether or not there is no input (engine stall) of a waveform-shaped crank signal within predetermined time (Step S161).

If there is any input of a waveform-shaped crank signal within predetermined time in this Step S161, i.e., if there is no engine stall ("NO"), the-CPU 55 returns to the processing of Step S150.

On the other hand, if, in Step S161, there is no input of a waveform-shaped crank signal within predetermined time ("YES") (i.e., if it is determined to be an engine stall), the CPU resets the a reverse rotation detection result to release the ignition output prohibition mode and return to the processing of Step S150 (Step S162).

According to the third embodiment of the reverse rotation release processing as described above, similarly to the second embodiment, even if a starter motor or a manual startup device is continuously operated after the detection of reverse rotation, the ignition output prohibition mode can be released to prevent startup from being disabled. Furthermore, any damage of startup drive system parts, such as starter idle gears, or an engine body can be prevented.

In addition, in the above second and third embodiments, the reverse rotation detecting coil 30*f* exclusive for detection of reverse rotation is provided in the generator 30. However, the invention is not limited thereto. A magnet AC generator that rotates in synchronization with the crankshaft 13 and outputs one-phase alternating voltage signals may be provided in addition to the generator 30, and an exciter coil may be used as the reverse rotation detecting coil 30*f*.

Figure 20:
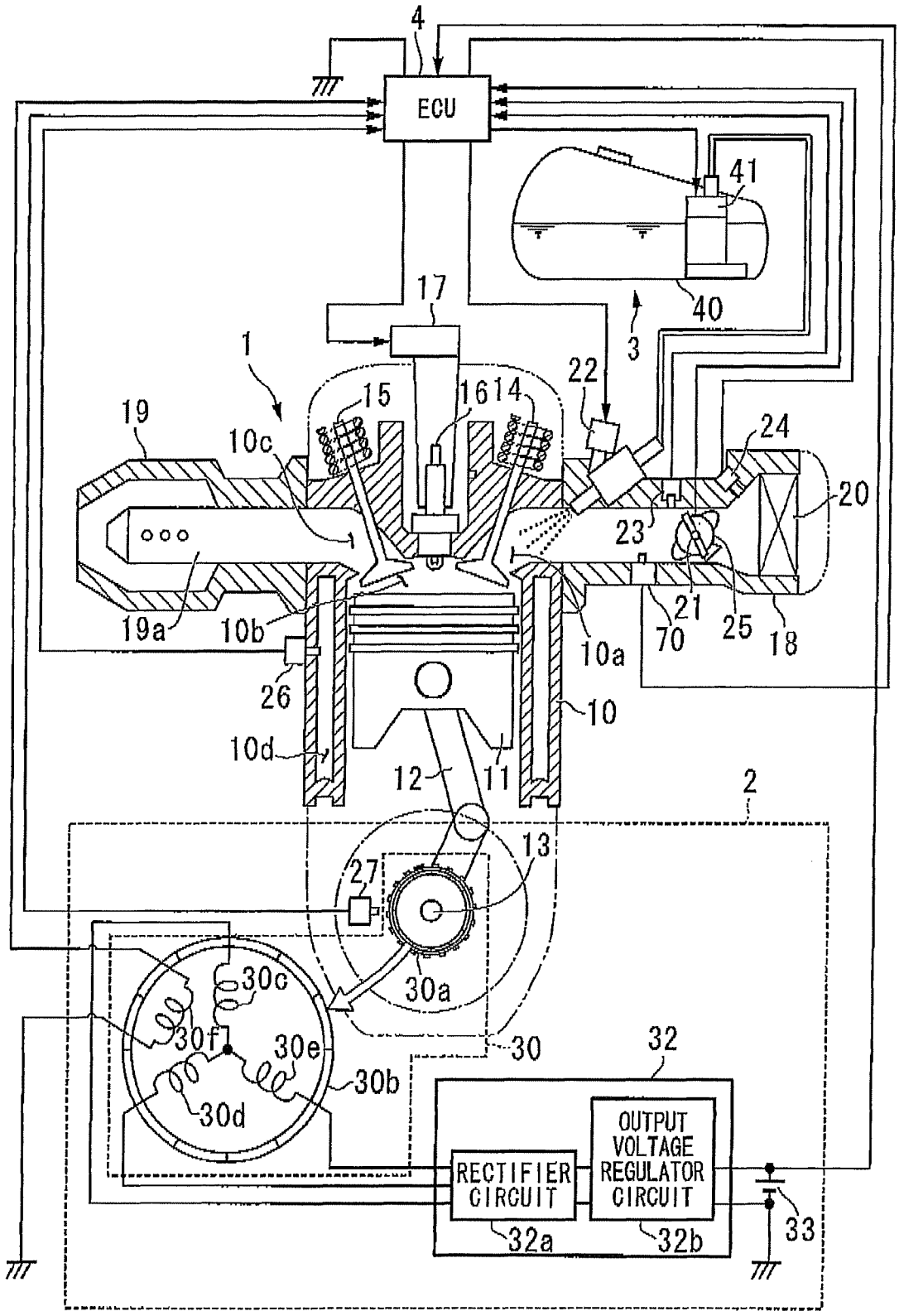
FIG. 20 is a drawing showing the installation position of an air flow sensor 70 when an air intake quantity is used as an intake state value instead of an intake pressure, in the control apparatus for an internal combustion engine (ECU 4) according to the second and the third embodiments of the invention.

Furthermore, in the above second and third embodiments, the intake pressure is used as an intake state value showing the intake state of the engine 1. However, the invention is not limited thereto. For example, an air intake quantity (intake rate) may be used. Specifically, as shown in FIG. 20, the air flow sensor 70 that outputs air intake quantity signals (intake rate signal) according to the air intake quantity within the intake pipe 18 to the downstream of the throttle valve 21 in the intake pipe 18 is provided.

Also, the air intake quantity signals output from the air flow sensor 70 are input to the A/D converter 54 of the ECU 4, and digital air intake quantity signals that are digitally converted by the A/D converter 54 are input to the CPU 55.

As such, it is preferable to provide the air flow sensor 70 on the downstream of the throttle valve 21 in order to enhance the detection accuracy of the air intake quantity. However, since the air flow sensor 70 is easily soiled in this position, the air flow sensor may be provided on the upstream of the throttle valve 21.

What is claimed is:

1. A control apparatus for an internal combustion engine, comprising:

a crankshaft provided in the internal combustion engine;

a crank angle detection unit that is provided in the internal combustion engine and that outputs a crank signal each time the crankshaft rotates by a predetermined angle;

a generator that rotates in synchronization with the rotation of the crankshaft and that outputs alternating voltage signals with one-phase; and a control unit, to which the alternating voltage signals are input, that ascertains ignition timings based on the crank signals, performs ignition control so as to spark the internal combustion engine at the ignition timings, performs polarity determination processing in which the control unit determines a polarity of the alternating voltage signal each predetermined cycle and determines a current polarity determination result when the polarities are identical over predetermined times, and performs reverse rotation detection processing in which the control unit obtains the current polarity determination result each time the crank signal is detected so that the control unit ascertains a polarity cycle of the alternating voltage signals and in which the control unit determines that the crankshaft is in reverse rotation and stops the ignition control when the ignition timing has arrived and the polarity cycle does not coincide with a polarity cycle at the time the crankshaft is in forward rotation.

2. The control apparatus for an internal combustion engine according to claim 1, wherein the predetermined cycle is less than or equal to ¼ of an inter-crank signal time between a previous crank signal detection and a current crank signal detection.

3. The control apparatus for an internal combustion engine according to claim 1, further comprising:

a reference voltage source generating reference voltage signals;

a comparing unit, to which the alternating voltage signals and the reference voltage signals are input, that compares the voltage value of the alternating voltage signals with the voltage value of the reference voltage signals, and that outputs comparison result signals indicating a comparison result; and a waveform shaping unit, to which the crank signals are input, that performs waveform shaping so that the crank signals are formed into square-wave pulse signals, the cycle of the pulse signal being the time required for the rotation of the predetermined angle, wherein the control unit determines the polarity of the alternating voltage signals based on the comparison result signals in the polarity determination processing, and obtains the current polarity determination each time the pulse signal is detected so as to ascertain the polarity cycle of the alternating voltage signals in the reverse rotation detection processing.

* * * * *